US005398107A

United States Patent [19]

Bartholmae et al.

[11] Patent Number: 5,398,107

[45] Date of Patent: Mar. 14, 1995

[54] APPARATUS FOR BIASING THE CURVATURE OF AN IMAGE CARRIER ON A TRANSFER DRUM

[75] Inventors: Jack N. Bartholmae, Duluth; E. Neal Tompkins, Atlanta, both of Ga.

[73] Assignee: T/R Systems, Inc., Atlanta, Ga.

[21] Appl. No.: 152,230

[22] Filed: Nov. 15, 1993

Related U.S. Application Data

[63] Continuation-in-part of Ser. No. 954,786, Sep. 30, 1992, Pat. No. 5,276,490.

[51] Int. Cl.[6] ..... G03G 15/14

[52] U.S. Cl. ..... 355/273; 355/271

[58] Field of Search ..... 355/271-274, 355/277, 282, 285, 289, 290, 295; 162/270, 271; 271/188, 209

[56] References Cited

U.S. PATENT DOCUMENTS

| | | | |
|---|---|---|---|
| 3,832,053 | 8/1974 | Goel et al. | 355/274 |
| 3,847,478 | 11/1974 | Young | 355/274 |
| 3,890,040 | 6/1975 | Schmidlin | 355/16 |
| 3,976,370 | 8/1976 | Goel et al. | 355/271 X |
| 4,379,630 | 4/1983 | Suzuki | 355/274 |
| 4,974,027 | 11/1990 | Landa et al. | 355/256 |
| 4,984,025 | 1/1991 | Landa et al. | 355/274 |
| 4,999,677 | 3/1991 | Landa et al. | 355/273 |
| 5,028,964 | 7/1991 | Landa et al. | 355/273 |
| 5,038,178 | 8/1991 | Hosoya et al. | 355/277 |
| 5,156,915 | 10/1992 | Wilson et al. | 428/425.8 |

*Primary Examiner*—Matthew S. Smith

*Attorney, Agent, or Firm*—Gregory M. Howison

[57] ABSTRACT

An electrophotographic print engine includes a photoconductor drum (20) that interfaces with a transfer drum (48) to form a transfer nip therebetween. Paper is disposed in a paper feed path (242) for traversal through the nip between two precurl rollers (242) and (244). The durometers of the two rollers (242) and (244) are different, such that one roller will cause the other to compress. This causes the paper to have a curvature bias in the direction of the curvature of the drum (48). The paper is then fed into an attachment nip formed between an attachment roller (198) and the drum (48). The paper is adhered thereto by electrostatic forces with the curvature of the paper allowing smaller forces to be utilized. In a multi-color print operation, the paper is maintained on the drum (48) for a number of passes until all images have been transferred thereto from the drum (20). A picker (248) then extracts the paper from the drum (48) and feeds it into a fuser mechanism. The fuser mechanism has two rollers (256) and (258) which apply a curvature bias in the opposite direction to that provided by the precurl rollers (244) and (246) to return the paper to a substantially planar conformation.

22 Claims, 17 Drawing Sheets

APPARATUS FOR BIASING THE CURVATURE OF AN IMAGE CARRIER ON A TRANSFER DRUM

CROSS-REFERENCE TO RELATED APPLICATION

This application is a continuation in part of U.S. patent application Ser. No. 07/954,786, filed Sep. 30, 1992, now U.S. Pat. No. 5,276,490, and entitled "Buried Electrode Drum for an Electrophotographic Print Engine".

TECHNICAL FIELD OF THE INVENTION

The present invention pertains in general to electrophotographic print engines, and more particular, to the feeding mechanism for feeding paper to an electrostatic drum or transfer belt.

BACKGROUND OF THE INVENTION

When utilizing electrostatic gripping on a transfer drum or belt, the voltage is typically applied at such a level that adherence of the paper to the drum is adequate. However, if the voltage is reduced below a certain level, some difficulty exists in adhering the paper to the drum or transfer belt. This is due to the fact that the paper has a tendency to lay flat, whereas the drum or transfer belt has an arcuate surface. Of course, after the paper has been on the drum for a sufficient amount of time, it will conform to the shape of the surface. Unfortunately, high speed copiers at present do not allow the paper to reside on the drum for very long.

In electrophotographic equipment, it is necessary to provide various moving surfaces which are periodically charged to attract toner particles and discharged to allow the toner particles to be transferred. At present, three general approaches have been embodied in products in the marketplace with respect to the drums. In a first method, the conventional insulating drum technology is one technology that grips the paper for multiple transfers. A second method is the semi-conductive belt that passes all the toner to the paper in a single step. The third technology is the single transfer to paper multipass charge, expose and development approach.

Each of the above approaches has advantages and disadvantages. The conventional paper drum technology has superior image quality and transfer efficiency. However, hardware complexity (e.g., paper gripping, multiple coronas, etc.), media variability and drum resistivity add to the cost and reduce the reliability of the equipment. By comparison, the single transfer paper-to-paper system that utilizes belts has an advantage of simpler hardware and more reliable paper handling. However, it suffers from reduced system efficiency and the attendant problems with belt tracking, belt fatigue and handling difficulties during service. Furthermore, it is difficult to implement the belt system to handle multipass to paper configuration for improved efficiency and image quality. The third technique, the single transfer-to-paper system, is operable to build the entire toner image on the photoconductor and then transfer it. This technique offers simple paper handling, but at the cost of complex processes with image quality limitations and the requirement that the photoconductor surface be as large as the largest image.

SUMMARY OF THE INVENTION

The present invention disclosed and claimed herein comprises a print engine for creating and transferring an image to an image carrier. The print engine includes a photoconductor member having a latent image carrying surface with at least a portion thereof being arcuate. An image system is operable to create a latent image on the photoconductor member. An arcuate transfer support member is disposed adjacent the photoconductor member to form a transfer nip therebetween such that the arcuate surface of the photoconductor member is a portion of the transfer nip. A flexible image carrier having an initial planar conformation is fed through a precurl feed device onto the image support member at an attachment point prior to the attachment nip. The precurl feed device is operable to apply a curvature bias to the image carrier such that the image carrier has an arcuate conformation associated therewith that is biased in the direction of curvature of the transfer support member. A decurl member is disposed on the opposite side of the transfer member from the precurl feed device to selectively extract the image carrier from the transfer support member after the image has been transferred thereto. A curvature bias is applied to the image carrier after extraction thereof, which curvature bias is opposite the curvature bias provided by the precurl feed device, such that the image carrier is substantially returned to the initial planar conformation. A control system controls the operation of the print engine to rotate the photoconductor member and image support member to effect a transfer of the latent image from the photoconductor member to the image carrier on the transfer support member as it passes through the transfer nip.

In another aspect of the present invention, the photoconductor member and the image support member are cylindrical in shape with the image carrier comprising paper. The paper feed device is comprised of first and second rollers, each having a durometer that differs from the other. Pressure is applied to the first and second rollers such that one thereof deforms more than the other. As the paper is fed through the nip formed between the two rollers, it is biased such that an arcuate shape is applied thereto.

In a further aspect of the present invention, as the paper exits the nip between the first and second rollers, it is attached at the attachment point to the surface of the image support member. This is effected through an electrostatic operation; Thereafter, the image carrier is maintained on the surface of the image support member by an electrostatic force.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
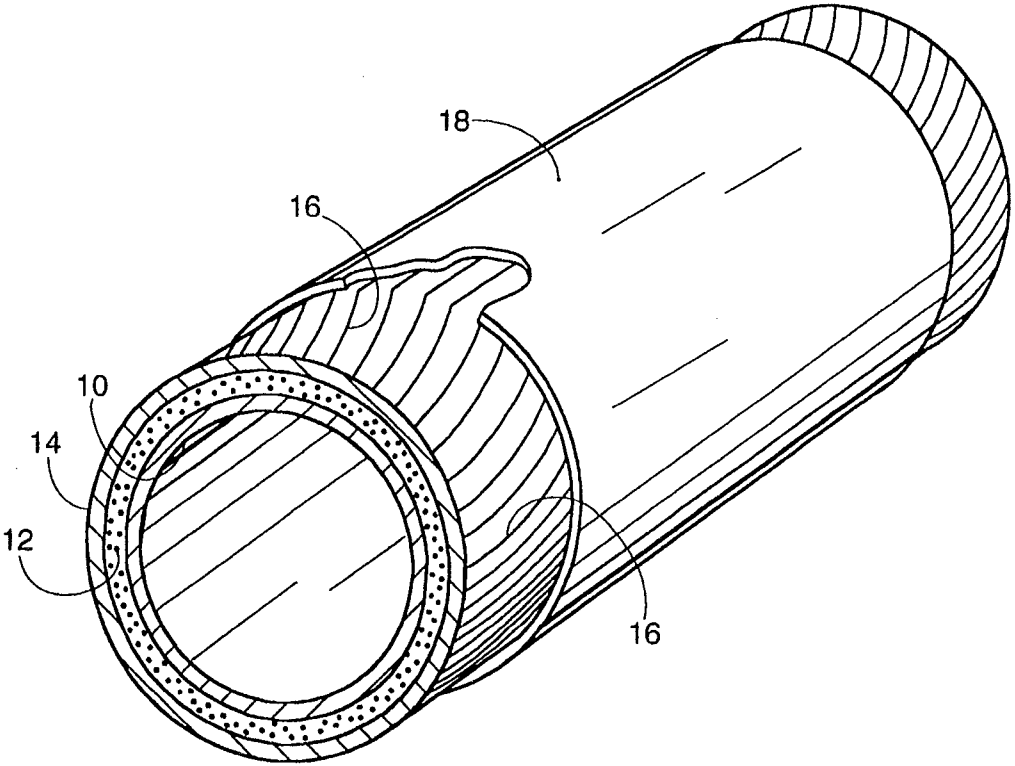
FIG. 1 illustrates a perspective view of the buried electrode drum of the present invention.

Referring now to FIG. 1, them is illustrated a perspective view of the buried electrode drum of the present invention. The buried electrode drum is comprised of an inner core 10 that provides a rigid support structure. This inner core 10 is comprised of an aluminum tube core of a thickness of approximately 2 millimeters (mm). The next outer layer is comprised of a controlled durometer layer 12 which is approximately 2–3 mms and fabricated from silicon foam or rubber. This is covered with an electrode layer 14, comprised of a plurality of longitudinally disposed electrodes 16, the electrodes being disposed a distance of 0.10 inch apart, center line to center line, approximately 0.1 mm. A controlled resistivity layer 18 is then disposed over the electrode layer to a thickness of approximately 0.15 mm, which layer is fabricated from carbon filled polymer material.

Figure 2:
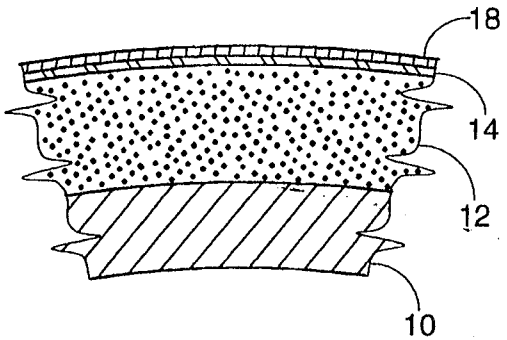
FIG. 2 illustrates a selected cross section of the drum of FIG. 1.

Referring now to FIG. 2, them is illustrated a more detailed cross-sectional diagram of the buried electrode drum. It can be seen that at the end of the buried electrode drum, the electrodes 16 within electrode layer 14 are disposed a predetermined distance apart. However, the portion of the electrodes 16, proximate to the ends of the drum on either side thereof are "skewed" relative to the longitudinal axis of the drum. As will be described hereinbelow, this is utilized to allow access thereto.

Figure 3:
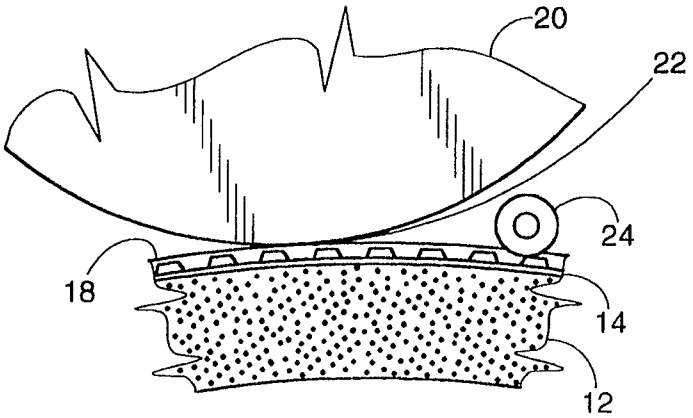
FIG. 3 illustrates the interaction of the photoconductor drum and the buried electrode drum of the present invention.

Referring now to FIG. 3, there is illustrated a side view of the buried electrode drum illustrating its relationship with a photoconductor drum 20. The photoconductor drum 20 is operable to have an image disposed thereon. In accordance with conventional techniques, a latent image is first disposed on the photoconductor drum 20 and then transferred to the surface of the buried electrode drum in an electrostatic manner. Therefore, the appropriate voltage must be present on the surface at the nip between the photoconductor drum 20 and the buried electrode drum. This nip is defined by a reference numeral 22.

A roller electrode 24 is provided that is operable to contact the upper surface of the buried electrode drum at the outer edge thereof, such that it is in contact with the controlled resistivity layer 18. Since the electrodes 16 are skewed, the portion of the electrode 16 that is proximate to the roller electrode 24 and the portion of the electrode 16 that is proximate to the nip 22 on the longitudinal axis of the photoconductor drum 20 are associated with the same electrode 16, as will be described in more detail hereinbelow.

Figure 4:
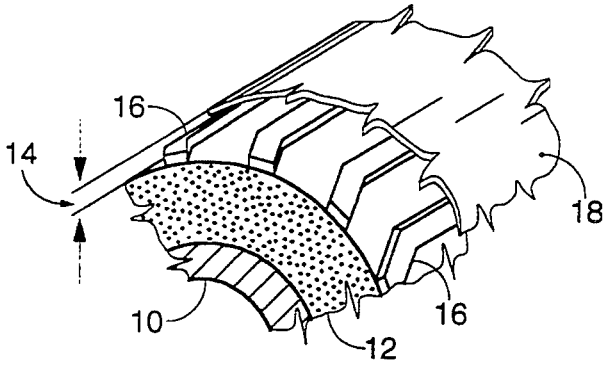
FIG. 4 illustrates a cutaway view of the electrodes at the edge of the drum.

Referring now to FIG. 4, there is illustrated a cutaway view of the buried electrode drum. It can be seen that the buried electrodes 16 are typically formed by etching a pattern on the outer surface of the controlled durometer layer 12. Typically, the electrodes 16 are initially formed by disposing a layer of thin, insulative polymer, such as Mylar, over the surface of the controlled durometer layer 12. An electrode structure is then bonded or deposited on the surface of the Mylar layer. In the bonded configuration, the electrode pattern is predetermined and disposed in a single sheet on the Mylar. In the deposited configuration, a layer of insulative material is disposed down and then patterned and etched to form the electrode structure. Although a series of parallel lines is illustrated, it should be understood that any pattern could be utilized to give the appropriate voltage profile, as will be described in more detail hereinbelow.

Figure 5A:
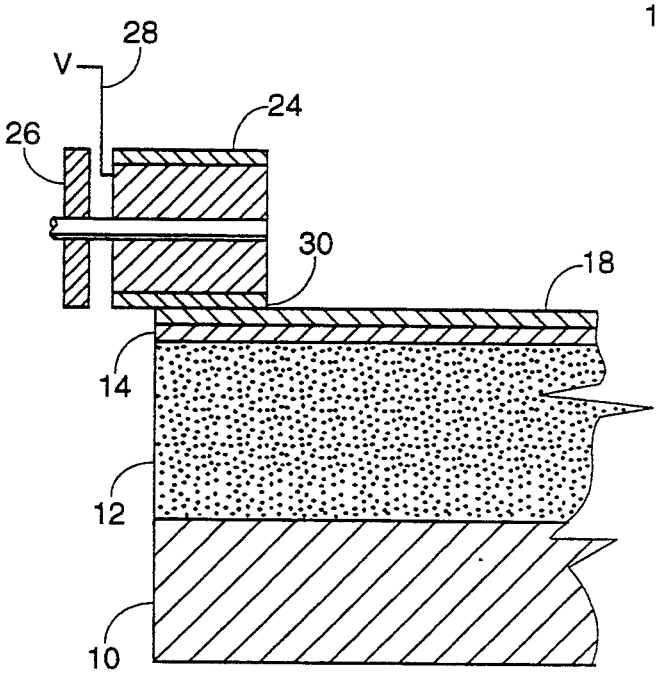
FIGS. 5*a* and 5*b* illustrate alternate techniques for electrifying the surface of the drum.
Figure 5B:
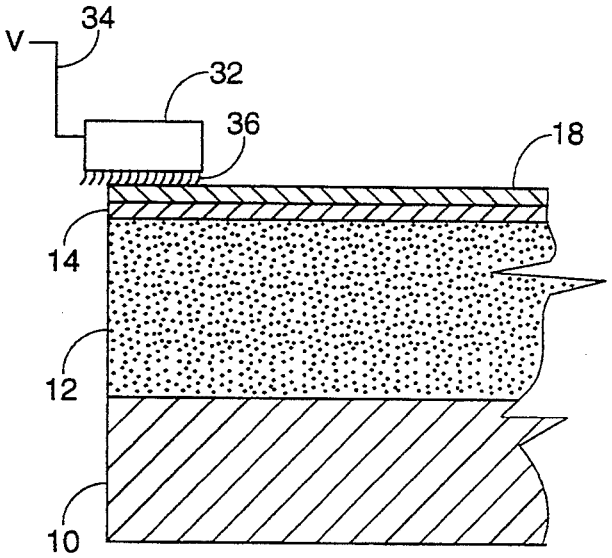

Referring now to FIGS. 5*a* and 5*b*, there are illustrated two techniques for contacting the electrodes. In FIG. 5*a*, a roller electrode is utilized comprising a cylindrical roller 24 that is pivoted on an axle 26. A voltage V is disposed through a line 28 to contact the roller 24. The roller 24 is disposed on the edge of the buried electrode drum such that a portion of it contacts the upper surface of the controlled resistivity layer 18 and forms a nip 30 therewith. At the nip 30, a conductive path is formed from the outer surface of the roller electrode 24 through the controlled resistivity layer 18 to electrode 16 in the electrode layer 14. In this manner, a conductive path is formed. The electrodes 16 in the electrode layer 14, as will be described hereinbelow, are operable to provide a low conductivity path along the longitudinal axis of the buried electrode drum to evenly distribute the voltage along the longitudinal axis.

FIG. 5*b* illustrates a configuration utilizing a brush 32. The brush 32 is connected through the voltage V through a line 34 and has conductive bristles 36 disposed on one surface thereof for contacting the outer surface of the control resistivity layer 18 on the edge of the buried electrode drum. The bristles 36 conduct current to the surface of the controlled resistivity layer 18 and therethrough to the electrodes 16 in the electrode layer 14. This operates identical to the system of FIG. 5*a*, in that the electrode 16 in the electrode layer 14 distributes the voltage along the longitudinal axis of the buried electrode drum.

Figure 6:
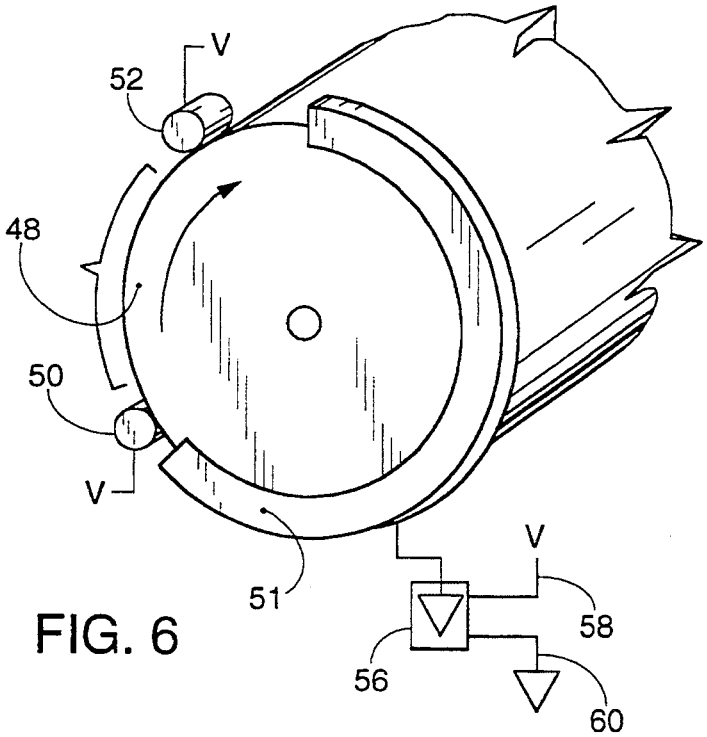
FIGS. 6 and 7 illustrate the arrangement of the electrifying rollers to the edge of the drum.
Figure 7:
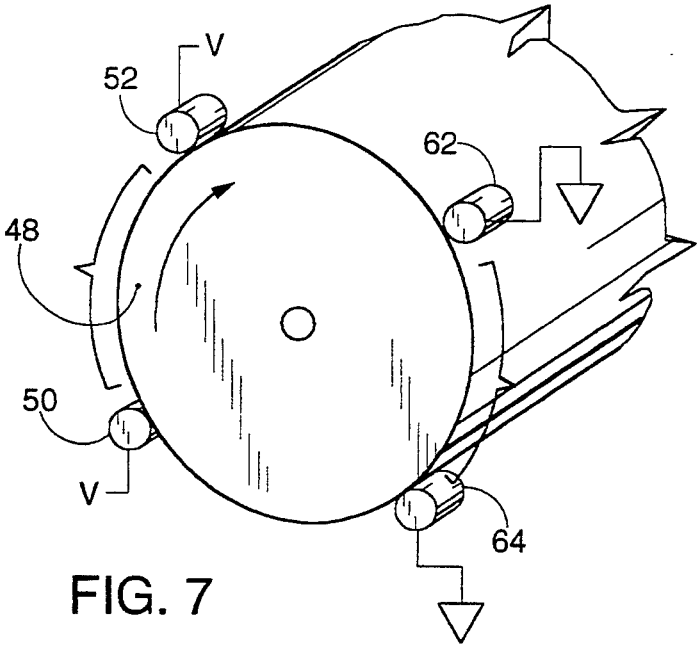

Referring now to FIGS. 6 and 7, there are illustrated perspective views of two embodiments for configuring the rollers. In FIG. 6, the buried electrode drum, referred to by a reference numeral 48, has two rollers 50 and 52 disposed at the edges thereof and a predetermined distance apart. The distance between the rollers 50 and 52 is a portion of the buried electrode drum 48 that contacts the photoconductor drum. A voltage V is disposed on each of the rollers 50 and 52 such that the voltage on the surface of the drum 48 is substantially equal over that range. A brush 51 is disposed on substantially the remaining portion of the circumference at the edge of the drum 48 such that conductive bristles contact all of the remaining surface at the edge of the drum 48. The electrode brush 51 is connected through a multiplexed switch 56 to either a voltage V on a line 58 or a ground potential on a line 60. The switch 56 is operable to switch between these two lines 58 and 60. In this configuration, one mode could be provided wherein the drum 48 was utilized as a transfer drum such that multiple images could be disposed on the drum in a multi-color process. However, when transfer is to occur, the switch 56 selects the ground potential on line 60 such that when the drum rotates past the electrode roller 52, the voltage is reduced to ground potential at the electrodes 16 that underlie the brush 51.

FIG. 7 illustrates the drum 48 and rollers 50 and 52 for disposing the positive voltage therebetween. However, rather than the brush 51 that is disposed around the remaining portion at the edge of the drum 48, two ground potential electrode rollers 62 and 64 are provided, having a transfer region disposed therebetween. Therefore, an image disposed on the buried electrode drum 48 can be removed from the portion of the line between rollers 62 and 64, since this region is at a ground potential.

Figure 8:
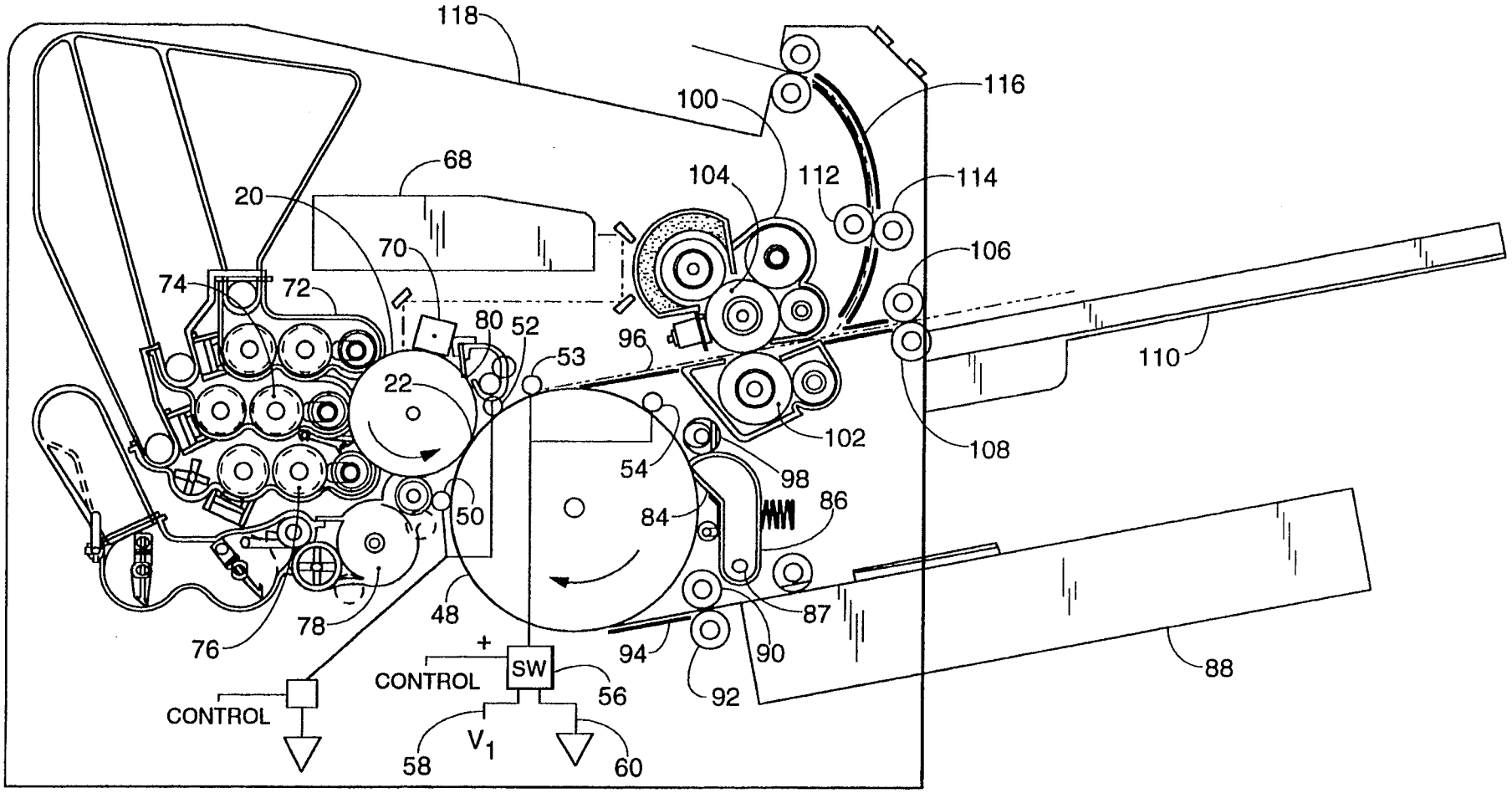
FIG. 8 illustrates a side view of a multi-pass-to-paper electrophotographic print engine utilizing the buried electrode drum.

Referring now to FIG. 8, there is illustrated a side view of a multi-pass-to-paper print engine. The print engine includes an imaging device 68 that is operable to generate a latent image on the surface of the PC drum 20. The PC drum 20 is disposed adjacent the buried electrode drum 48 with the contact thereof provided at the nip 22. Supporting brackets [not shown] provide sufficient alignment and pressure to form the nip 22 with the correct pressure and positioning. The nip 22 is formed substantially midway between the rollers 50 and 52, which rollers 50 and 52 are disposed at the voltage V. A scorotron 70 is provided for charging the surface of the photoconductor drum 20, with three toner modules, 72, 74 and 76 provided for a three-color system, this being conventional. Each of the toner modules 72, 74 and 76, are disposed around the periphery of the photoconductor drum 20 and are operable to introduce toner particles to the surface of the photoconductor drum 20 which, when a latent image passes thereby, picks up the toner particles. Each of the toner modules 72–76 is movable relative to the surface of the photoconductor drum 20. A fourth toner module 78 is provided for allowing black and white operation and also provides a fourth color for four color printing. Each of the toner modules 72–78 has a reservoir associated therewith for containing toner. A cleaning blade 80 is provided for cleaning excess toner from the surface of the photoconductor drum 20 after transfer thereof to the buried electrode drum 48. In operation, a three color system requires three exposures and three transfers after development of the exposed latent images. Furthermore, the modules 72–76 are connected together as a single module for ease of use.

The buried electrode drum 48 has two rollers 53 and 54 disposed on either side of a pick up region, which rollers 53 and 54 are disposed at the positive potential V by switch 56 during the transfer operation. A cleaning blade 84 and waste container 86 are provided on a cam operated mechanism 87 such that cleaning blade 84 can be moved away from the surface of the buried electrode drum 48 during the initial transfer process. In the first transfer step, paper (or similar transfer medium) is disposed on the surface of the buried electrode drum 48 and the surface of drum 48 disposed at the positive potential V, and also for the second and third pass. After the third pass, the now complete multi-layer image will have been transferred onto the paper on the surface of the buried electrode drum 48.

The paper is transferred from a supply reservoir 88 through a nip formed by two rollers 90 and 92. The paper is then transferred to a feed mechanism 94 and into adjacent contact with the surface of the drum 48 prior to the first transfer step wherein the first layer of the multi-layer image is formed. After the last layer of the multi-layer image is formed, the rollers 53 and 54 are disposed at ground potential and then the paper and multi-layer image are then rotated around to a stripper mechanism 96 between rollers 53 and 54. The stripper mechanism 96 is operable to strip the paper from the drum 48, this being a conventional mechanism. The stripped paper is then fed to a fuser 100. Fuser 100 is operable to fuse the image in between two fuse rollers 102 and 104, one of which is disposed at an elevated temperature for this purpose. After the fusing operation, the paper is feed to the nip of two rollers 106 and 108, for transfer to a holding plate 110, or to the nip between two rollers 112 and 114 to be routed along a paper path 116 to a holding plate 118.

Figure 9:
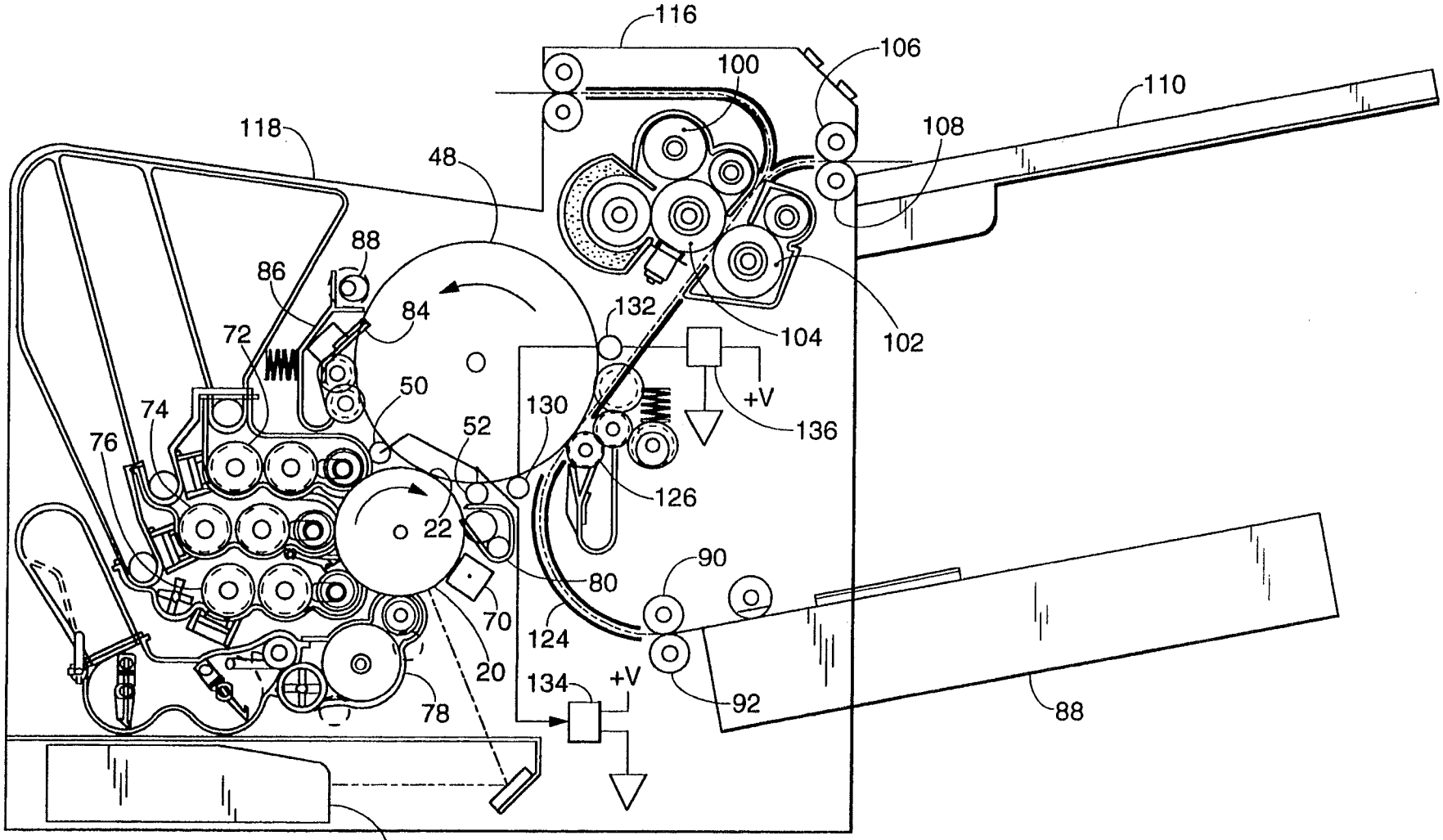
FIG. 9 illustrates a cross section of a single pass-to-paper print engine utilizing the varied electrode drum.

Referring now to FIG. 9, there is illustrated a side view of an intermediate transfer print engine. In this system, the three layers of the image are first disposed on the buried electrode drum 48 and then, after formation thereof, transferred to the paper. Initially, the surface of the drum is disposed at a positive potential by rollers 50 and 52 in the region between rollers 50 and 52. During the first pass, the first exposure is made, toner from one of the toner modules disposed on the latent image and then the latent image transferred to the actual surface of the buried electrode drum 48. During the second pass, a third toner is utilized to form a latent image and this image transferred to the drum 48. During the third pass, the third layer of the image is formed as a latent image using the second toner, which latent image is then transferred over the previous two images on the drum 48 to form the complete multi-layer image.

After the image is formed, paper is fed from the tray 88 through the nip between rollers 90 and 92 along a paper path 124 between a nip formed by a roller 126 and the drum 48. The roller 126 is moved into contact with the drum 48 by a cam operation. The paper is moved adjacent to the drum 48 and thereafter into the fuser 100. During transfer of the image to the paper, two rollers 130 and 132 are provided on either side of the nip formed between the roller 126 and the drum 48. These two rollers 130 and 132 are operable to be disposed at a positive voltage by multiplexed switches 134 and 136 during the initial image formation procedure. During transfer to the paper, the rollers 130 and 132 are disposed at a ground voltage with the switches 134 and 136. However, it should also be understood that these voltages could be a negative voltage to actually repulse the image from the surface of the drum 48.

Figure 10:
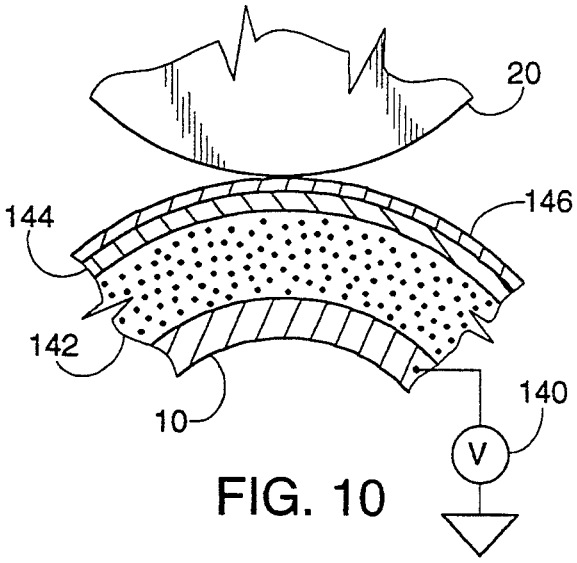
FIG. 10 illustrates an alternate embodiment of the overall construction of the drum assembly.

Referring now to FIG. 10, there is illustrated an alternate embodiment of the overall construction of the drum assembly. The aluminum support or core layer 10 comprises the conductive layer in this embodiment, which aluminum core 10 is attached to a voltage supply 140. The voltage supply 140 provides the gripping and transfer function, as will be described hereinbelow. The voltage supply 140 is applied such that it provides a uniform application of the voltage from the voltage supply 140 to the underside of a resilient layer 142. The resilient layer 142 is a conductive resilient layer with a volume resistivity under $10^{10}$ Ohm-cm. The layer 142 is fabricated from carbon filled elastomer or material such as butadiene acrylonitrile. The thickness of the layer 142 is approximately 3 mm. Overlying the resilient layer 142 is a controlled resistivity layer 144 which is composed of a thin dielectric layer of material with a thickness of between 50 and 100 microns. The layer 144 has a non-linear relationship between the discharge (or relaxation) time and the applied voltage such that, as the voltage increases, the discharge time changes as a function thereof. Overlying the layer 144 is a layer of support material 146, which is typically paper. The photoconductor drum 20 contacts the paper 146.

Figure 11:
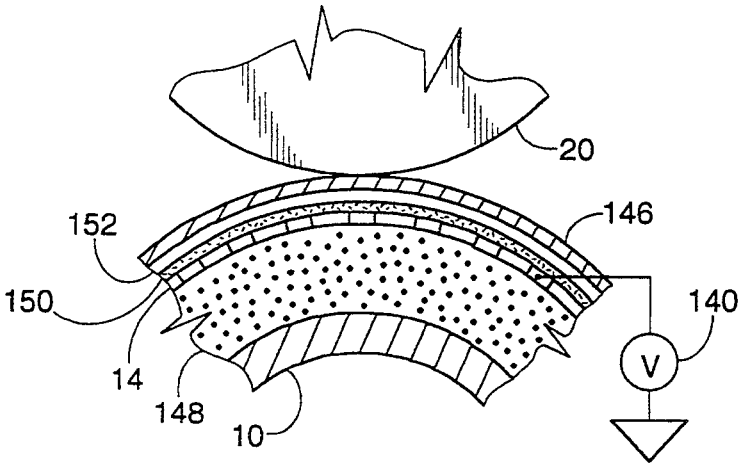
FIG. 11 illustrates another embodiment wherein a resilient layer of the insulating material is disposed over the aluminum core with electrodes disposed on the surface thereof.

Referring now to FIG. 11, there is illustrated another embodiment wherein a resilient layer 148 of an insulating material comprised of Neoprene is disposed over the aluminum core 10 with electrodes 14 disposed on the surface thereof. The electrodes 14 are disposed in a layer, each of the electrodes 14 comprised of an array of conductors separated by a predetermined distance. The electrodes 14 are covered by a gripping layer 150, similar to the controlled resistivity layer 144 in FIG. 10, the gripping layer 150 covered by a controlled resistivity layer with a surface resistivity of between $10^6$–$10^{10}$ Ohm/sq. The controlled resistivity layer 152 is fabricated from FLEX 200 and has a thickness of 75 microns. This is covered by the support layer 146. The distance between the electrodes 14 is defined by the following equation:

$$V_d = \frac{i_d \times s \times r}{4w} \tag{1}$$

where $V_d$ is the allowable voltage droop between electrodes, $i_d$ is the toner transfer current;

s is the spacing of the electrodes;

r is the sum of the surface resistivity and volume resistance of the layer 150, and w is the overall length of the electrode, which is nominally the width of the drum 10.

The voltage source 140 is connected to the electrodes 14, as described hereinabove, wherein a conductive brush or roller directly contacts an exposed portion of the electrodes on the edge of the drum or conducts through the upper conductive layers.

Figure 12:
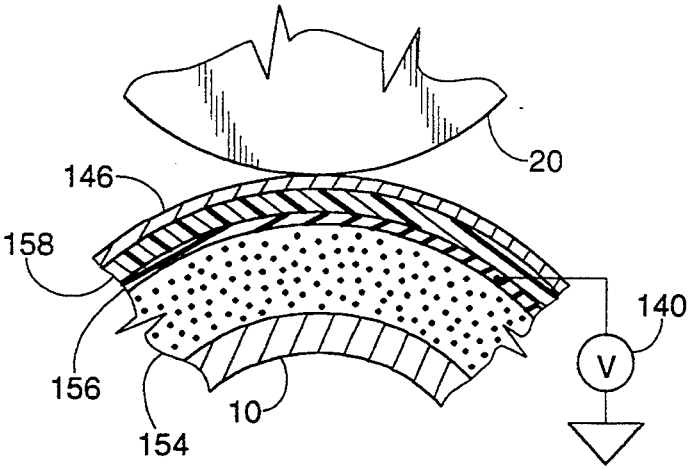
FIG. 12, illustrates another embodiment of the present invention wherein the core of the drum is covered by an insulating layer with a conducting layer disposed on the upper surface thereof.

Referring now to FIG. 12 there is illustrated another embodiment of the present invention wherein the core of the drum 10 is covered by an insulating layer 154 of a thickness 3 mm and of a material utilizing Neoprene, with a conducting layer 156 disposed on the upper surface thereof. The conductive layer 156 is connected to the voltage supply 140. This layer provides the advantage of separating the electrical characteristics of the material from the mechanical characteristics. This is covered by an insulative layer 158, similar to the gripping layer 144, with the paper 146 disposed on the upper surface thereof.

Figure 13:
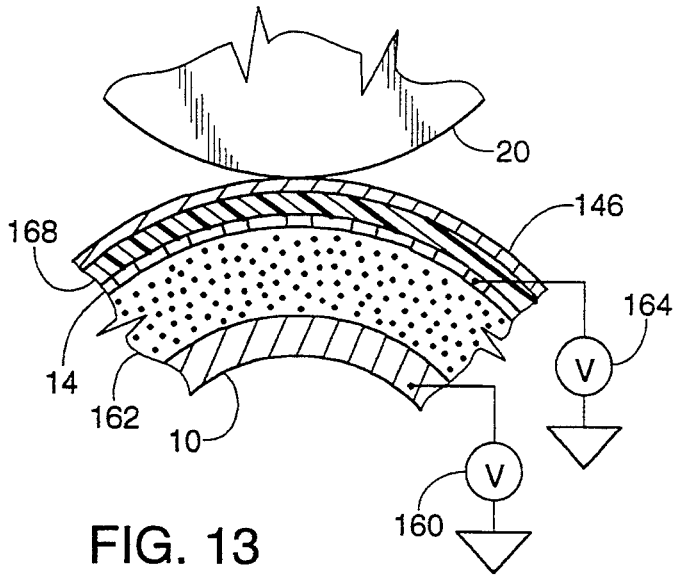
FIG. 13 illustrates another embodiment of the transfer drum.

Referring now to FIG. 13, there is illustrated another embodiment of the transfer drum. A voltage source 160 is connected to the core 10 and the core 10 then has a conductive resilient layer 162 disposed on the surface thereof. The electrodes 14 are disposed in a layer on the upper surface of the layer 162 with the voltage source 164 connected thereto through a conductive brush or such. The voltage supplies 160 and 164 are used to establish the uniform voltage on the underside of the resilient conductive layer 162 and a voltage profile on the top side. The benefit of this configuration is to provide a variable surface potential while maintaining a uniform gripping voltage source. A gripping layer 168 is disposed on the upper surface of the electrodes 14, similar to the gripping layer 158, which is then covered by the paper 146. Additionally, it is noted that by applying the voltage 164 that is different than the voltage of supply 160 (perhaps even 0), a voltage profile with a voltage minimum will be obtained at the entrance to the nip. This will reduce the pre-nip discharge for multiple transfer operation. This voltage minimum characteristic is also shown in FIG. 6*a*.

Figure 14:
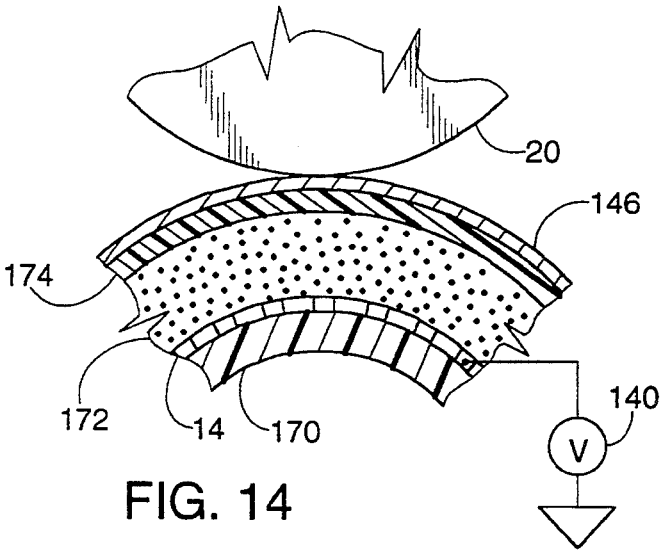
FIG. 14 illustrates another embodiment of the transfer drum construction.

Referring now to FIG. 14, there is illustrated another embodiment of the transfer drum construction. In this configuration, an insulating core 170 is provided, similar to the dimension of the core 10 but fabricated from insulating material such as polycarbonate. The electrode layer with electrodes 14 is then disposed on the surface of the insulating core 170 and the voltage source 140 connected thereto. A conducting resilient layer 172 is disposed on the surface of the electrodes 14 to a thickness of 3 mm and fabricated from butylacrylonitrile. A gripping layer 174, similar to the gripping layer 144 is disposed on top of the resilient layer 172, with the paper 146 disposed on the upper surface thereof.

Figure 15:
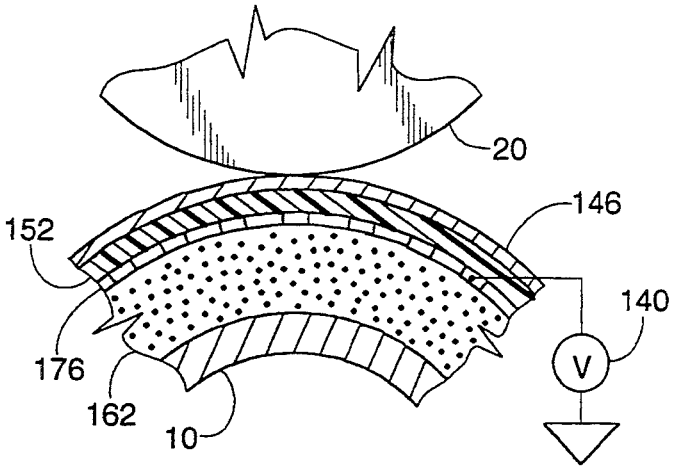
FIG. 15 illustrates another embodiment of the transfer drum construction.

Referring now to FIG. 15, there is illustrated another embodiment of the transfer drum construction. The conducting layer 156 in FIG. 11 is removed such that a layer of interdigitated electrodes 176 can be utilized between the gripping layer 152 and the resilient layer 148. This resilient layer, as described above, is an insulating layer. The voltage source 140 is connected to the electrodes 176. The interdigitated electrodes increase the value of w in Equation 1, thus allowing a much higher value of r in Equation 1. The interdigitated electrodes are illustrated below in FIG. 17.

Figure 16:
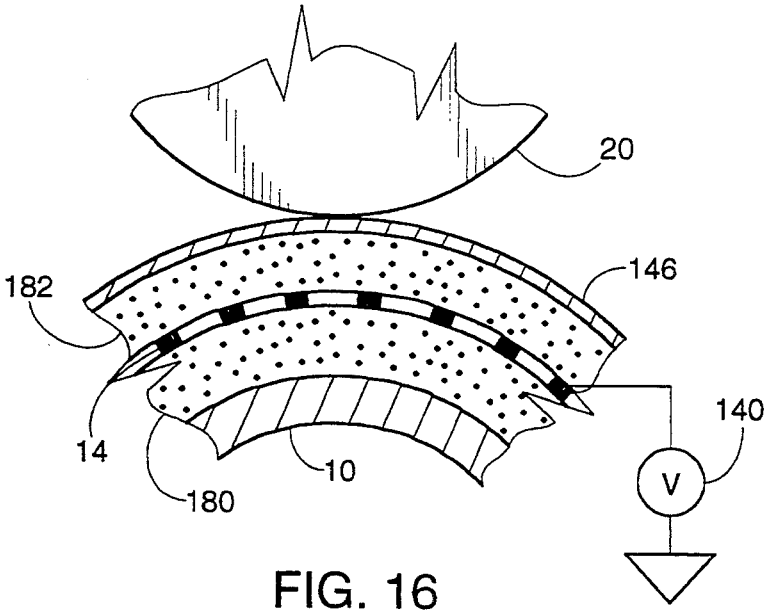
FIG. 16 illustrates another embodiment of the transfer drum.

Referring now to FIG. 16, there is illustrated another embodiment of the present invention. The core 10 has disposed thereon a first resilient layer 180, covered by the electrode layer having electrodes 14 disposed therein. The electrodes 14 are connected to a voltage source 140 through conductive brushes or the such. A second resilient layer 182 is disposed over the electrodes 14 with the paper 146 disposed on the surface thereof. The layer 180 can be a resilient layer that is resistive or insulative. The resilient layer 182 is resistive with a resistivity of less than $10^{10}$ Ohms/cm. The advantage provided by this configuration is that the physical effects (i.e., nip pressure variations) of the electrode layer are reduced by enclosing the electrodes 14 in two resilient layers 180 and 182.

Figure 17:
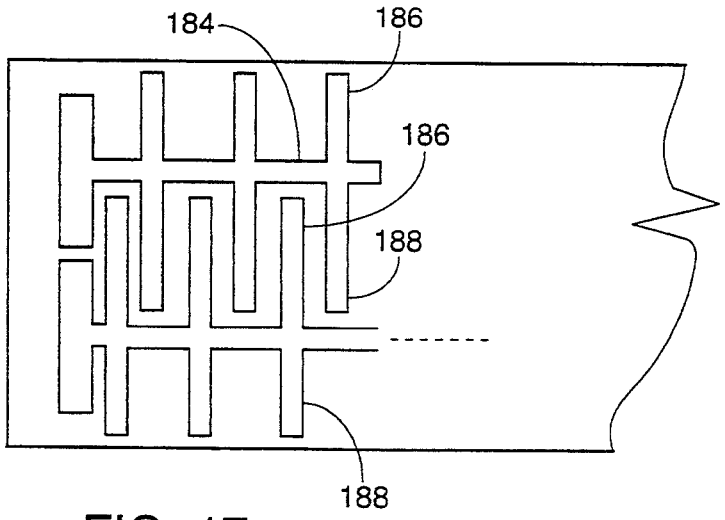
FIG. 17 illustrates an embodiment illustrating the interdigitated electrodes described above with respect to FIG. 15.

Referring now to FIG. 17, there is illustrated an embodiment illustrating the interdigitated electrodes described above with respect to FIG. 15. The interdigitated electrodes each have a plurality of longitudinal arms 184 with extended or interdigitated electrodes 186 and 188 extending from either side thereof. Adjacent electrodes will have the interdigitated arms or electrodes 186 and 188 offset along the longitudinal arm 184 such that they will interdigitate with each other, thereby effectively increasing apparent "w" of Equation 1, such that the controlled resistivity layer can be at a higher resistivity to the point that it can be eliminated.

Figure 18:
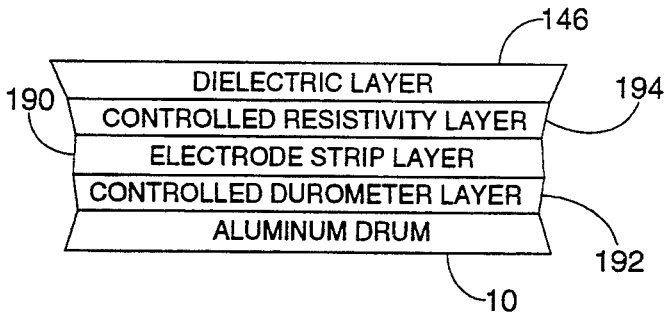
FIG. 18 illustrates a detail of the physical layers in a section of the BED drum with the paper attached thereto.

Referring now to FIG. 18, there is illustrated a detail of the physical layers in a section of the BED drum 48 with the paper 146 attached thereto. An electrode strip 190 is disposed between a controlled durometer layer 192 and a controlled resistivity layer 194. The controlled durometer layer 192 represents the resilient layer 142 in FIG. 10 and subsequent figures. The controlled resistivity layer 194 represents the gripping layer 144 in FIG. 10. The controlled durometer layer 192 is disposed between the electrode strip layer 190 and the aluminum drum 10, the electrode strip layer 190 either comprising a plurality of electrodes in strips, as described above, or a single continuous layer.

Figure 19:
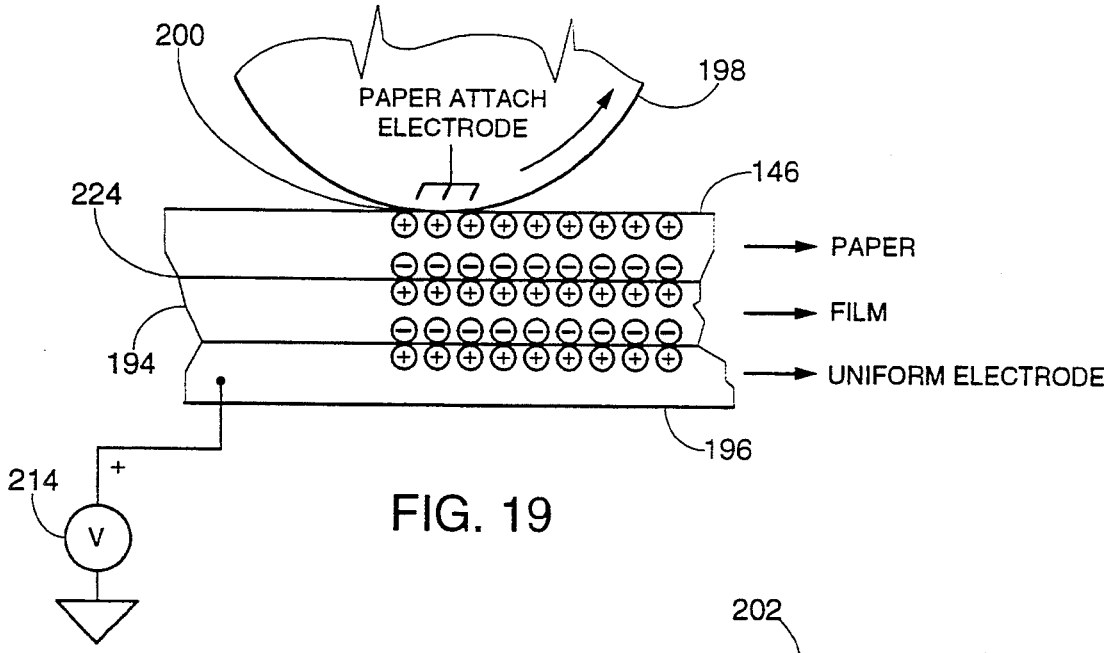
FIG. 19 illustrates a diagrammatic view of the paper layer, the film layer and the uniform electrode layer.

Referring now to FIG. 19, them is illustrated a diagrammatic view of the paper layer 146, the film layer 194 and the uniform electrode 196 layer, which comprises the electrode strip layer 190. A paper attach electrode 198 is provided, which is operable to contact the paper and dispose a potential thereon which, in the preferred embodiment, is ground. At the point the electrode 198 contacts the paper 146, a nip 200 is formed.

Figure 20:
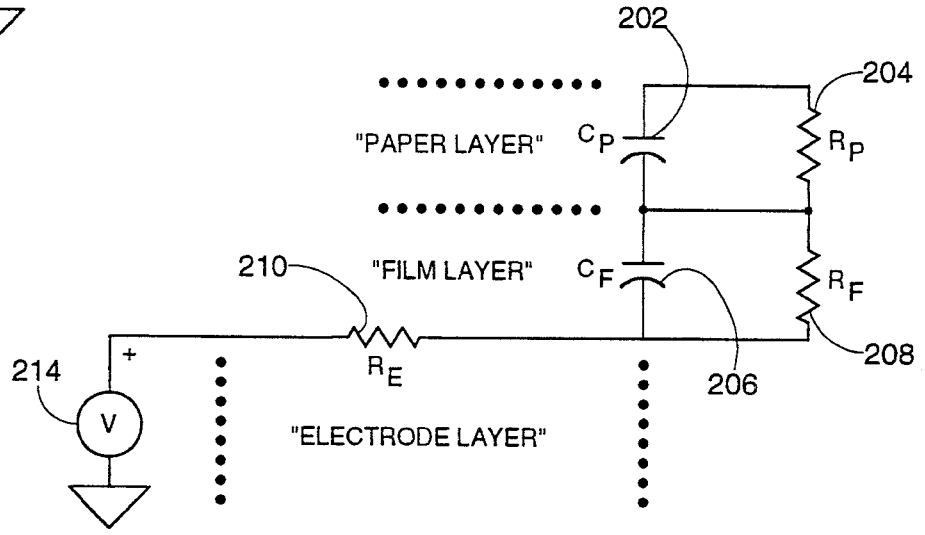
FIG. 20 illustrates a schematic representation of the paper and film layers.

Referring now to FIG. 20, there is illustrated a schematic representation of the layers 146, 174 and 196. A first capacitor 202, labelled $C_P$, represents a paper layer 146, with a parallel resistor 204 labelled $R_P$. The film layer 194 is represented by a capacitor 206 labelled $C_F$, with a resistor 208 disposed in parallel therewith, labelled $R_F$. The electrode layer 196 is represented by a resistance 210 labelled $R_E$, which goes to a transfer/attach power supply.

Figure 21:
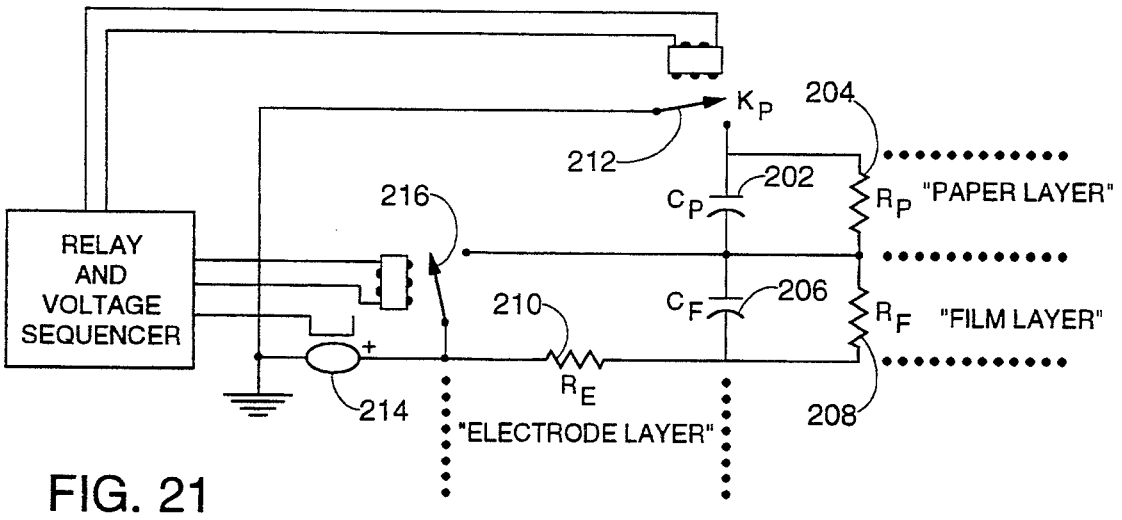
FIG. 21 illustrates a schematic diagram of the overall operation of the transfer drum.

Referring now to FIG. 21, there is illustrated a schematic diagram of a simulator circuit capable of simulating the overall operation of the transfer drum 48. The schematic representation shows a switch 212 that is labelled $K_P$ which is the charge relay, which is operable to connect the upper surface of a paper layer 146, represented by the capacitor 206 and resistor 204, to ground when the switch 212 is closed. A attach/transfer voltage source 214 is provided, having the positive voltage terminal thereof connected to the most distal side of resistor 210 and essentially to the uniform electrode layer 197. The other side of the supply 214 is connected to ground. A switch 216 is provided which is labelled $K_F$, which is operable to connect the positive side of the supply 2 14 to the top of the film layer 194. This is a discharge operation that will be described in more detail hereinbelow.

When paper is first presented to the drum in the nip 200 for attachment, the charge distribution of FIG. 19 is illustrated wherein positive charges are attracted to the upper surface of the paper and negative charges attracted to the lower surface thereof. Similarly, the positive charges are attracted to the upper surface of the film layer 194 and negative charges attracted to the lower surface thereof, with positive charges attracted to the surface of the uniform electrode 196. This results in mirror images of equal and opposite charges formed at each interface boundary between the various layers 146, 194 and 196. With the dielectric layers, layers 146 and 194, most of these charges are just below the surfaces of the respective layers and cannot cross the interface boundary between the film. However, the charges are strongly attracted to each other and provide the attractive force which holds the paper on the drum. This attractive force is normal to the surface of the drum and directly bonds the paper layer 146 to the drum in that direction. Additionally, this normal force is operable for generating the frictional forces that secure the paper to the drum in the remaining two axis, preventing paper slip. The source charge for the paper attachment is the attach/transfer supply 214. The switch 212 represents the paper attach electrode 198.

When a selection of paper enters the nip 200, the composite capacitor formed by the paper and film layers is charged in a manner similar to the charging of $C_P$ and $C_F$ as illustrated in FIG. 21 when the relay $K_P$ is closed. If the dwell time of a section of paper in the attach nip 200 is sufficiently long relative to the time constant of the resistor 210 ($R_E$) and the series connected pair capacitor $C_P$ and $C_F$, this composite capacitor will charge to a voltage very nearly equal to that of the attach/transfer supply 214. Fully charging the paper film composite capacitor results in the maximum transfer of charge and therefore the generation of the maximum attractive or bonding force of the paper to the drum assembly.

After the paper leaves the attach nip 200, the capacitance that is associated with the paper and film layers begins to discharge. The paper layer then discharges at a rate determined by its dielectric content and volume resistivity, with near complete discharge, i.e., to only a small voltage across the paper, occurring in less than 300 milliseconds. This discharge is similar to the discharge behavior of $C_P$ and $R_P$ in FIG. 21. The film layer also discharges at a rate determined by its dielectric constant and the volume resistivity (and other factors), but the time required is much longer than that of the paper. The film layer 194 may require more than 200 seconds for near complete discharge, and does so in a manner that is similar to the discharge characteristics of $C_F$ and $R_F$ in FIG. 4.

The larger discharge time of the film layer 94 accounts for the ability of the transfer drum to grip paper much longer than the discharge time of the paper would indicate. Even though the voltage across the paper collapses relatively quickly, the trapped charges that were induced at the paper's surface are trapped at the paper surface by the residual voltage on the film layer. The trapped charges eventually migrate back into the bulk of the paper, but only after the film layer 194 has discharged significantly.

Because of the large discharge time of the film layer 194, some mechanism to discharge the film completely between successive paper attach intervals is required. This function is simulated by the relay $K_F$ in FIG. 21. The actual discharge mechanism is very similar to the attach electrode 198 in FIG. 19, but the discharge electrode is held at the same potential as the electrode layer 196 to facilitate discharge. The discharge electrode is physically located upstream of the paper attach area and is in contact with the drum 48 only during the paper attach operation.

With further reference to FIG. 21, the operation of the layered structure of FIG. 18 will be described in more detail as to its effect on the paper gripping operation. By way of the example, in the case where a very resistant paper or transparency material is utilized, the resistance of resistor 210 ($R_E$) is much less than the resistance of the paper $R_P$, and the resistance of resistor 210 ($R_E$) is much less than resistor $R_F$. The composite capacitor will charge to the applied voltage with the time constant $R_E C_{EQ}$, where:

$$\frac{C_P C_F}{(C_P + C_F)} \quad (2)$$

If the time constant $R_E$, $C_{EQ}$ is much less than the time constant $T_N$, where $T_N$ is equal to the time that a section of paper is present in the nip attachment 200, then the voltage across the capacitor will very nearly reach the magnitude of the attach/transfer voltage of voltage supply 214 ($V_A$). The voltages across each of the components of the composite capacitor, $C_P$ and $C_F$, are given by:

$$V_{CP} = V_A(C_F/(C_P + C_F)) \quad (3)$$

$$V_{CF} = V_A(C_P/(C_P + C_F)) \quad (4)$$

For the actual paper and film layer of the drum, the analogous equations are:

$$V_P = V_A(\epsilon_F/((t_F/t_P)\epsilon_P + \epsilon_F)) = V_{CP} \quad (5)$$

$$V_F = V_A(\epsilon_P/((t_P/t_F)\epsilon_F + \epsilon_F)) = V_{CF} \quad (6)$$

where:

$\epsilon_P$=dielectric constant of the paper $\epsilon_F$=dielectric constant of the film $t_P$=thickness of the paper $t_P$=thickness of the film The magnitude of the gripping force is directly proportional to the amount of charge trapped at the paper/-film interface and, to maximize it, the composite capacitance, $C_{EQ}$, must be as large as possible. From Equation 2, it can be seen that, for a given paper, the largest value that the composite capacitance can have is $C_P$. This occurs when $C_F$ is much greater than $C_P$. Therefore, Equation 2 can be rewritten as:

$$C_{EQ} = A\epsilon_P\epsilon_F/(t_F\epsilon_P + t_F\epsilon_P) \quad (7)$$

where A=area of the paper section in the nip. From this, it can be seen that, for a given paper with a dielectric constant of $\epsilon_P$ and thickness $t_P$, $C_{EQ}$ approaches a value of $C_P$ if the dielectric constant of the film is much greater than the dielectric constant of the paper, or the thickness of the film is much smaller than the thickness of the paper. Under these conditions, Equations 5 and 6 indicate that, during attach, most of the voltage will be developed across the paper, a desirable condition for good gripping.

In the case where the resistance $R_E$ is substantially equal to the resistance of the paper $R_P$, i.e., for very low resistance paper, the equations will differ somewhat. When the section of paper 146 enters the nip 200, both $C_P$ and $C_F$ will act as short circuits. However, if $C_P$ is much less than $C_F$, $C_P$ begins charging to:

$$V_P = V_A(R_P/(R_P + R_E)) \quad (8)$$

with a time constant of:

$$(R_E R_P/(R_E + R_P))C_P \quad (9)$$

Then, if the time constant $R_E C_F$ is much less than $T_N$, and $R_P C_F$ is much less than $T_N$, $C_P$ will charge to $V_A$ with a time constant $(R_E + R_P)$ $C_F$ while $C_P$ completely discharges through $R_P$. Equation 8 indicates that, to maximize the voltage across the paper, $R_E$ should be selected such that $R_E$ is much less than $R_P$. Additionally, it is equally important that $C_F$ be selected such that $C_P$ is much less than $C_F$.

For the case where the resistance of the paper is much less than the resistance of the electrode layer 196 and much less than the resistance of the film, Equation 8 shows that very little voltage will be developed across the paper. Thus, only a very small gripping force will be generated.

After the paper 146 is gripped onto the upper surface of the film layer 194, toner must then be transferred from the photoconductor to the paper. Since toner transfer efficiency is a function of applied voltage in the transfer nip, it is desirable that the dielectric composed of the paper and film layers have no memory of the attach operation (i.e., these layers would be fully discharged) as a section of the paper 146 enters the transfer nip, thus allowing complete and independent control of the transfer nip voltage. However, if the paper and film were fully discharged, they would not be electrostatically attached to the drum, an undesirable situation.

Figure 22:
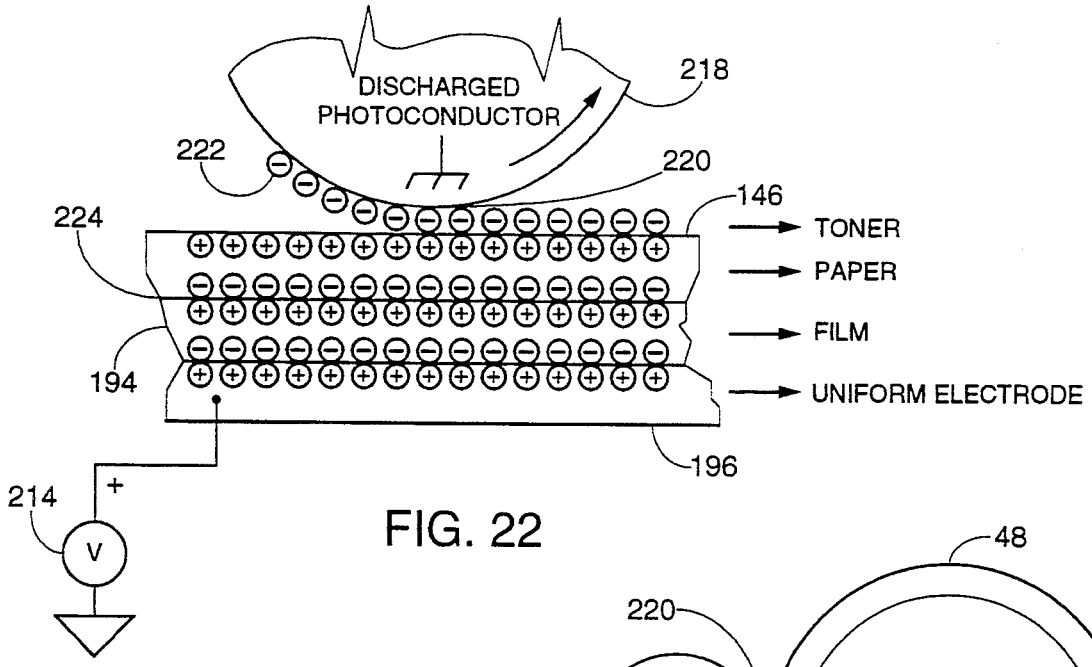
FIG. 22 illustrates a cross sectional diagram of the structure of FIG. 19, when it passes under a photoconductor drum, which is in a discharge mode.

Referring now to FIG. 22, them is illustrated a cross sectional diagram of the structure of FIG. 19, when it passes under a photoconductor drum 218 which is in a discharge mode, i.e., there is ground potential applied thereto. Toner particles 222 are disposed on the photoconductor drum 218 and have a negative charge placed thereon. This is a conventional transfer operation. When the paper 146 passes under the photoconductor drum 218, a transfer nip 220 is formed. Since the electrode layer 196 is a uniform electrode, the voltage of the layer 196 is that of the attach/transfer voltage source 214. This will result in a strong force of attraction at the film and paper interface, represented by a reference numeral 224.

Figure 23:
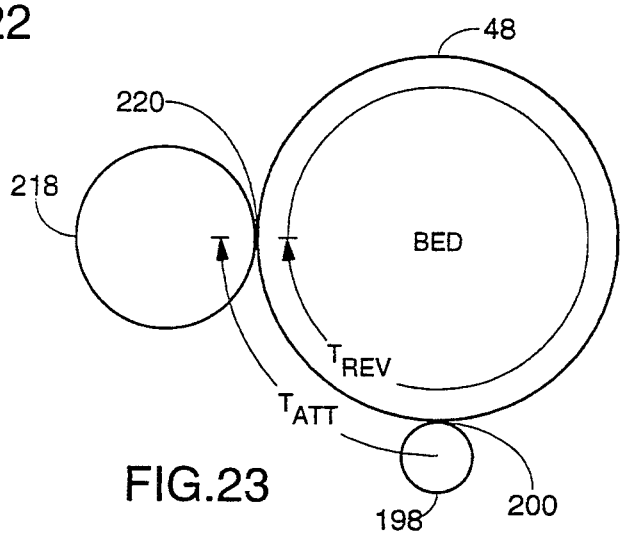
FIG. 23 illustrates another view of the spatial difference between the photoconductor drum and the paper attach electrode disposed about the buried electrode drum.

Referring now to FIG. 23, there is illustrated another view of the spatial difference between the photoconductor drum 218 and the paper attach electrode 198 disposed about the buried electrode drum 48. It can be seen that the distance between the paper attach electrode 198 and the photoconductor 218 requires a time $T_{ATT}$ for the paper to move from the paper attach nip 200 to the transfer nip 220. Additionally, the time for the paper to traverse the entire circumference of the drum 48 is the time $T_{REV}$. Additionally, a discharge roller 201 is provided which is connected to ground for completely discharging the surface.

Figure 24:
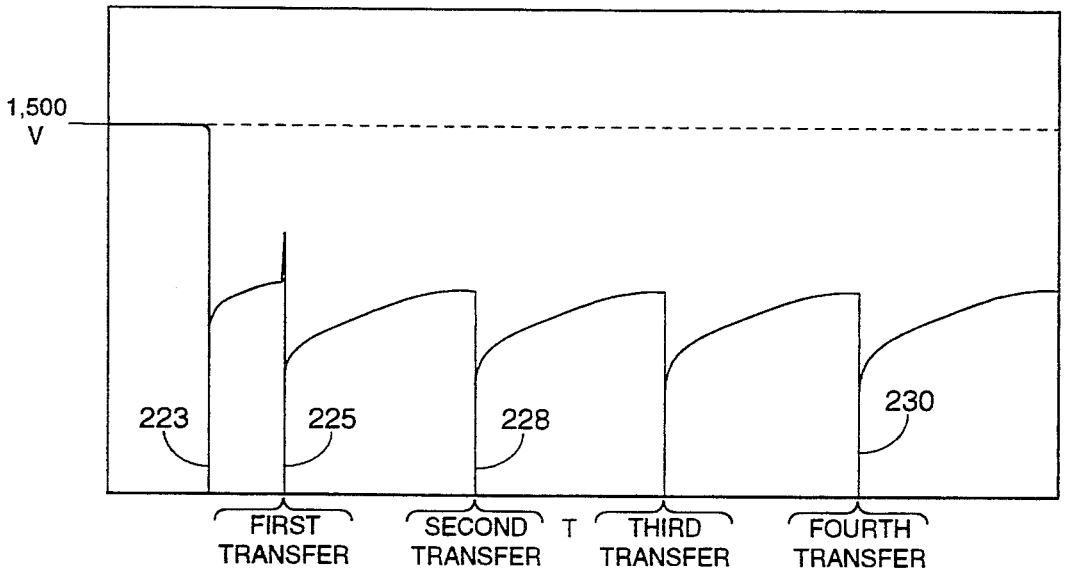
FIG. 24 illustrates a plot of simulated voltage vs. time for an arbitrary section of paper as it travels around the drum 48 four times in a four pass (i.e., color) print.

Referring now to FIG. 24, there is illustrated a simulated voltage versus time plot for an arbitrary section of paper as it travels around the drum 48 four times in a four pass (i.e., color) print. The first transition to zero potential is caused by the paper attach electrode 198 contacting the drum and the paper passing into the paper attach nip 200, this represented by the relay 212 ($K_P$) in FIG. 21 closing. This is represented by a point 223. The paper will then move to the toner transfer nip 220, where the voltage will again go to a zero potential, as represented by a point 225, the time difference between points 223 and 225 being $T_{ATT}$. This will be a toner transfer point. Then the paper traverses around the drum and the voltage will increase to a higher voltage level (relative to ground potential) at a point 226 after time $T_{REV}$, at which time the paper will again arrive at the toner transfer nip 220 and the potential will again go to zero as represented by a point 228. Of course, the paper attach electrode 198 has been removed after the last portion of the paper was attached to the drum 48, in the first pass, this being a single pass. This will continue for three more passes up to a point 230. Each of the transitions at the transfer nip 220 are also represented by closure of the relay 214 in the simulation of FIG. 21. Because the surface of the photoconductor drum 218 is either discharged or at a low potential (relative to the applied transfer voltage of source 214), the photoconductor drum 218 performs much like the attach electrode 20 in an electrical sense. Although not discussed or shown in detail, the voltage of source 214 is stepped up slightly for each successive toner transfer to account for the thickness of the previous toner layer, this being a conventional operation.

Figure 25:
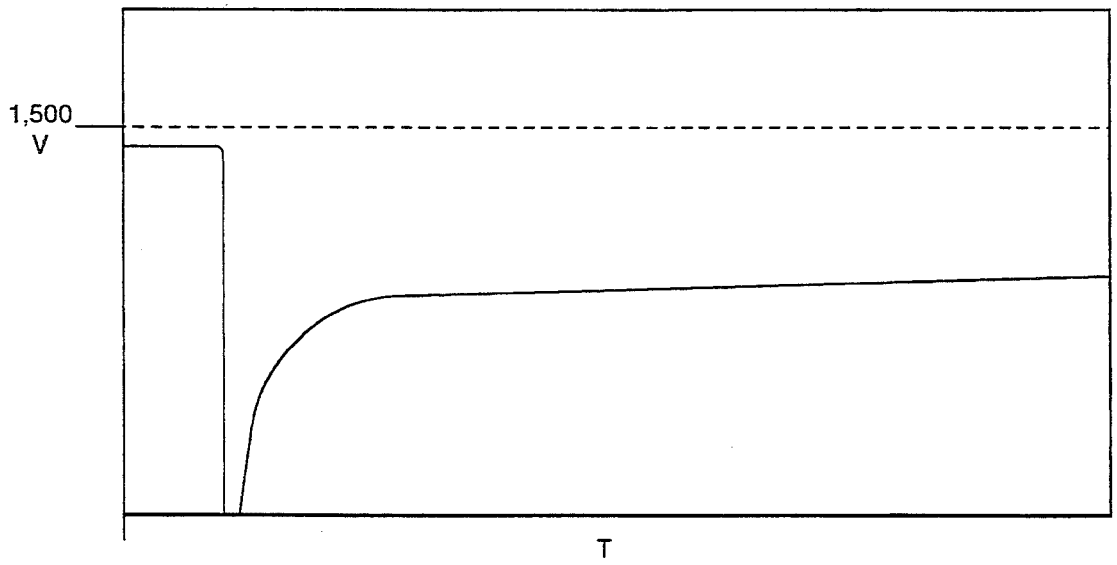
FIG. 25 illustrates a simulated voltage vs. time plot of a single pass.

The surface of the paper is held at a zero potential for the entire time that it is in either the paper attach nip 200 or the transfer nip 220. During this time, the paper and film composite capacitor ($C_{EQ}$) becomes very nearly charged to the full potential of the attach/transfer source 214. Upon leaving either of these nips, the capacitance $C_{EQ}$ begins to discharge. The first portion of the discharge occurs between points 223 and 225 and is quite rapid, approximately 170 milliseconds, this due primarily to the paper discharging. This is equivalent to the capacitance $C_P$ discharging through the resistance $R_P$ and is illustrated in more detail in FIG. 25. In the second portion of the curve between points 225 and 228, and subsequent passes to point 230, it can be seen that the discharge is quite slow, wherein only a partial discharge is apparent. This is equivalent to the capacitance CF discharging through the resistance $R_F$. In the preferred embodiment, the voltage on the electrode layer 196 is held at a constant voltage of 1500 volts for the curves of FIG. 24 and FIG. 25.

The voltage available for transfer of toner is the difference between the voltage at the surface of the paper and ground potential, just before the paper enters the transfer nip 220. Thus, for a constant voltage on drum 48, the amount that the film layer discharges between each successive toner transfer pass (i.e., each revolution of the drum 48) determines the amount of voltage available for toner transfer.

The amount of time available for the paper/film discharge after the paper is attached is the time $T_{ATT}$ for the first layer of toner. The amount of time available for the paper/film discharge is the time $T_{REV}$, as illustrated in FIG. 23. This time is required for the subsequent layers of toner and, therefore, the voltage across the fihn layer 194 must not discharge to a level too low to maintain attraction, but it must discharge sufficiently to allow a voltage difference at the transfer nip 220. The film layer 194 should have a discharge time constant approximately equal to $T_{ATT}$ to minimize the effect of the residual voltage on the film layer during transfer of the first layer of toner, and yet reserve sufficient potential across the film to maintain gripping of the paper (if $R_FC_F$ is much less than $T_{ATT}$, gripping cannot be maintained). However, for the configuration illustrated in FIG. 23, $T_{ATT}=T_{REV}/4$ and gripping must be maintained for at least as long as $T_{REV}$.

This relationship suggests that the film layer should have a voltage dependant discharge time constant; that is, the RC time constant (or relaxation time constant) of the film should be small for high potentials and large for low potentials. A voltage dependent characteristic of this type would allow large potentials to be used for paper attach and toner transfer and allow a small but sufficient residual potential in the film layer for paper gripping maintenance. Because the residual would be small, effects of previous paper attach and toner transfer operations on those subsequent thereto would be minimized.

It is well known that the discharge time constant or RC time constant for a capacitor or film layer is characterized by the equation:

$$V=V_o*\epsilon-(t/RC) \tag{10}$$

where:

V is the voltage across a film, $V_o$ is the initial voltage, t is time,

C is the capacitance of the film, and

R is the resistance of the film.

The characteristic discharge time is that time that equals the product of RC, and so the exponential term is unity. Specifically the discharge time is given by the equation:

$$t=RC \tag{11}$$

It is of particular importance that in the case of a preferred gripping layer the characteristics of the film do not behave according to the above equation. Specifically, the behavior of the film discharge time constant is a function of voltage as well as R and C, or more specifically R and/or C are a function of voltage and not constant for the film material. And more specifically, for the improved performance of the gripping layer, the discharge time for the film decreases with increasing voltage:

$$V = V_o * \epsilon - (t/f(R,C,V)) \quad (12)$$

Figure 25A:
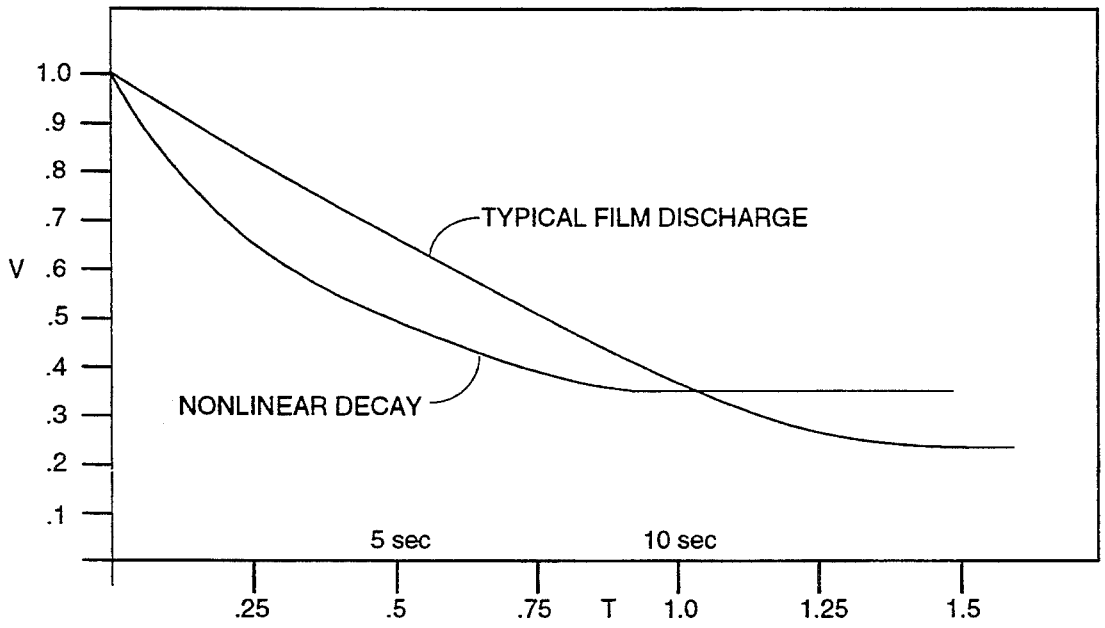
FIG. 25*a* illustrates a graph of decay voltages.

In this case, the exponent is a function that is dependent on V. This "nonlinear" behavior is important for the gripping layer to decay sufficient for transfer voltage and yet retain sufficient voltage for gripping. This is shown graphically in the graph of FIG. 25*a*. Note that the preferred nonlinear characteristic in the nonlinear decay curve is reflected in quicker initial discharge characteristics for good transfer and then a slowing to a higher value for improved gripping. Tables 1 and 2 illustrate discharge characteristics for two films whose dielectric contents are very nearly equal. The film associated with Table 1 is an extruded tube of Elf Atochem Kynar Flex 2800, a proprietary copolymer formed using polyvinylidene fluoride (PVDF) and hexafluoropropolene (HFP). The average wall thickness was approximately 4 mils. The manufacturer's specification for the dielectric for the film is (9.4—10.6) $\epsilon_o$. The volume resistivity is specified as $2.2\times10^{14}$ Ohm-centimeters. The film associated with Table 2 was obtained from DuPont as cast 8.5"×11" sheets of Tedlar (TST20SG4), a polyvinyl fluoride (PVF) polymer. The average thickness was approximately 2 mils. The manufacture's specifications for the dielectric constant of the film is $(8-9)\epsilon_o$. The volume resistivity is specified as $1.8\times10^{14}$ Ohm-centimeters.

TABLE 1

| INITIAL VOLTAGE V | SECONDS FOR DISCHARGE TO ¾V | V/2 | 0.37V | V/4 |
|---|---|---|---|---|
| 1600 | 1.4 | 4.9 | 10.3 | 22.1 |
| 1400 | 1.7 | 5.1 | 12.8 | 27.3 |
| 1200 | 2.2 | 8.1 | 16.6 | 37.6 |
| 1000 | 2.9 | 9.6 | 19.8 | 41.0 |
| 800 | 5.3 | 16.8 | 32.1 | 54.9 |
| 600 | 8.2 | 26.4 | 45.9 | 78.9 |
| 400 | 12.4 | 39.4 | 64.5 | 105.8 |
| 200 | 13.3 | 43.9 | 74.9 | 123.8 |

TABLE 2

| INITIAL VOLTAGE V | SECONDS FOR DISCHARGE TO ¾V | V/2 | 0.37V | V/4 |
|---|---|---|---|---|
| 1600 | 4.1 | 13.4 | 22.8 | 39.4 |
| 1400 | 6.0 | 19.1 | 29.7 | 49.4 |
| 1200 | 7.2 | 21.3 | 36.1 | 59.6 |
| 1000 | 8.8 | 27.7 | 45.7 | 74.7 |
| 800 | 10.9 | 33.1 | 54.7 | 87.5 |
| 600 | 13.5 | 40.3 | 65.0 | 103.8 |
| 400 | 16.7 | 48.6 | 78.3 | 123.8 |
| 200 | 20.3 | 59.8 | 95.6 | 147.8 |

Figure 26:
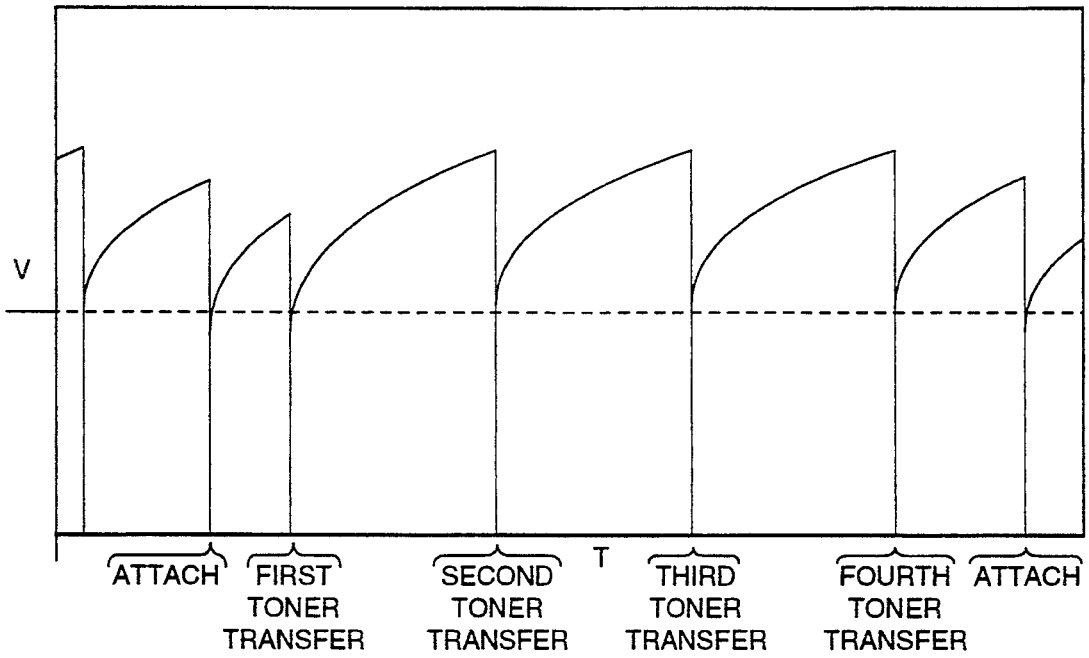
FIG. 26 illustrates a simulated voltage vs. time plot of a four pass operation.
Figure 27:
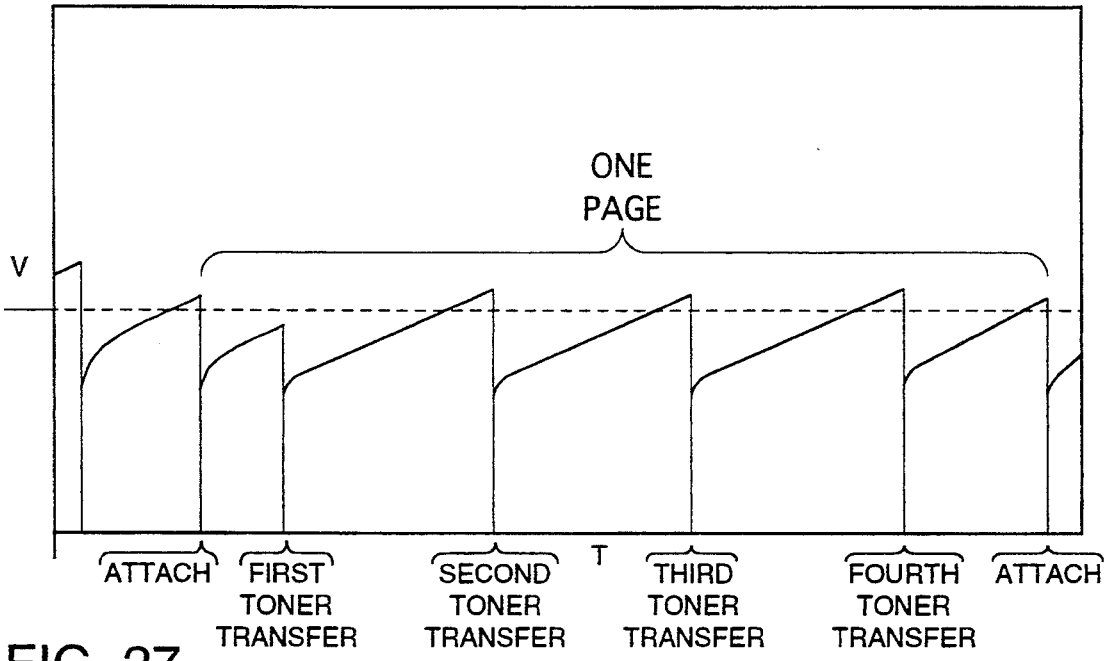
FIG. 27 illustrates a simulated voltage vs. time plot of a four pass operation.
Figure 27A:
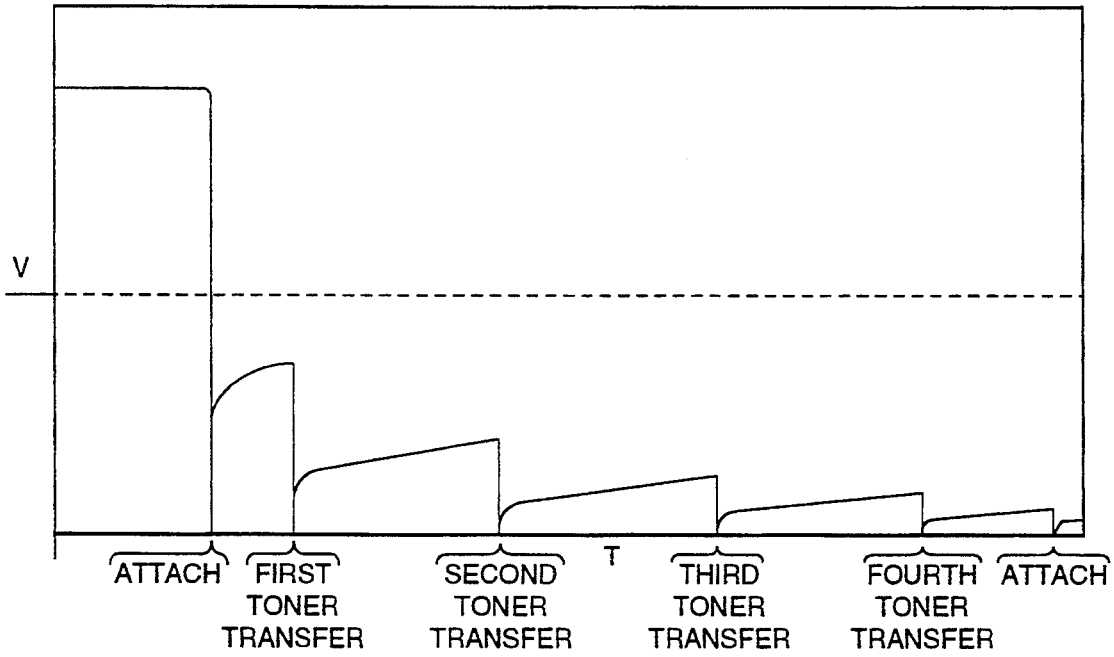
FIG. 27*a* illustrates an alternate simulated voltage vs. time plot of a four pass operation utilizing Mylar.

The discharge time constant ($R_FC_F$) measured for low starting voltages are very nearly equal and are in agreement with the manufacturers stated values for dielectric constant and volume resistivity. Each of the two films exhibit the voltage dependent discharge time constant. By comparing the discharge times in the ¾V column, it can be seen that the film associated with Table 1 discharges faster at high voltages than does the film of Table 2. The response for Table 1 is illustrated in FIG. 26 and the response for the film of Table 2 is illustrated in FIG. 27. FIG. 27*a* illustrates a response for a film such as Mylar, which response illustrates that insufficient voltage is available for subsequent (multiple) passes. Film voltage is held at a constant 2200 volts for each type. The discharge characteristics of FIG. 26 are preferred. In the film of FIG. 27*a*, the film was manufactured by Apollo as a transparency material. Its chemical and electrical properties are unknown, but the dielectric constant approximates that of Mylar®, approximately $3\epsilon_o$. The thickness is approximately 6 mils.

Figure 28:
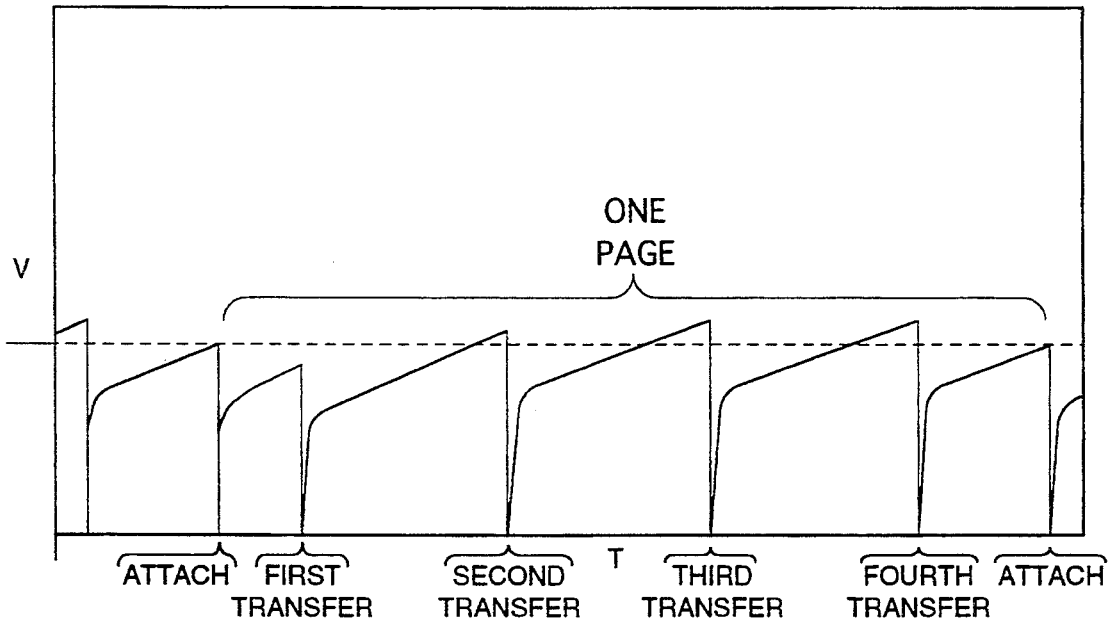
FIG. 28 illustrates a simulated voltage versus time plot for an arbitrary section of paper as it travels around the drum four times during a four pass color print with no discharge before attack.
Figure 29:
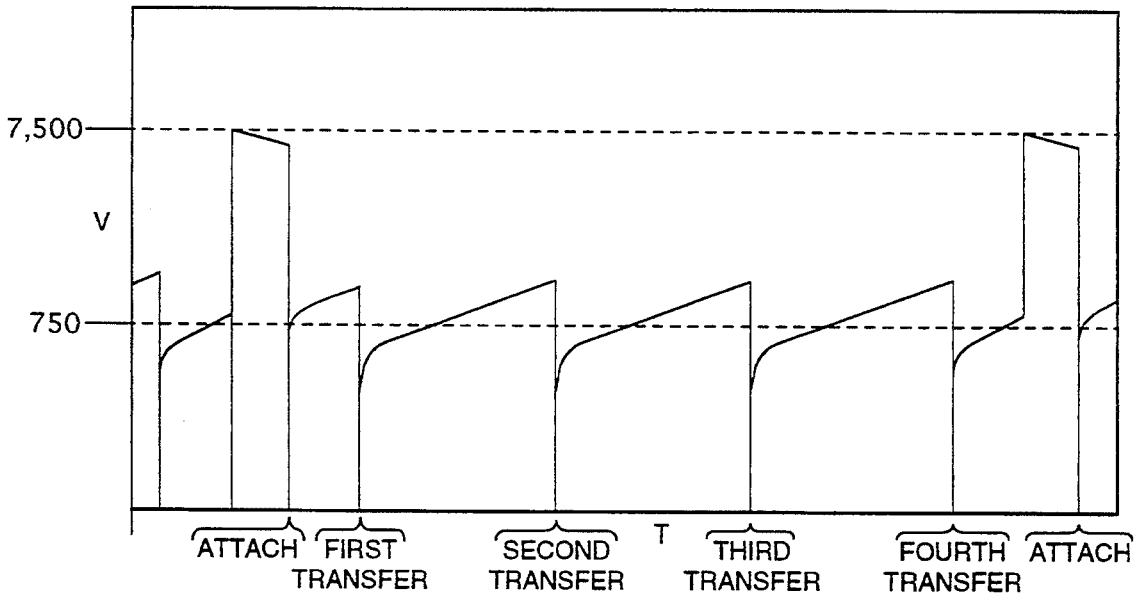
FIG. 29 illustrates the operation of FIG. 29 with discharge.

Referring now to FIG. 28, there is illustrated a simulated voltage versus time plot for a sheet of paper as it travels around the drum four times during a four pass color print. The attach and transfer voltage transition shown in the center of the figure are for a single page of a multi-page print job. The voltage available for paper attach or toner transfer is the difference between the voltage at the surface of the paper and ground potential. In FIG. 28, it can be noted that the voltage available for paper attach is dependent on the voltage left on the film layer by the previous (and fourth toner layer) transfer. As a result, subsequent pages of a multi-page print job will not be gripped as firmly as the first page. This situation is remedied as illustrated in FIG. 29 by applying a discharge voltage with the relay 216 labelled $K_F$ to the upper surface of the film layer 194. The voltage is approximately 1500 volts in the attach operation in the nip 200 whereas the attach voltage in FIG. 28 is less than 750 volts.

Figure 30:
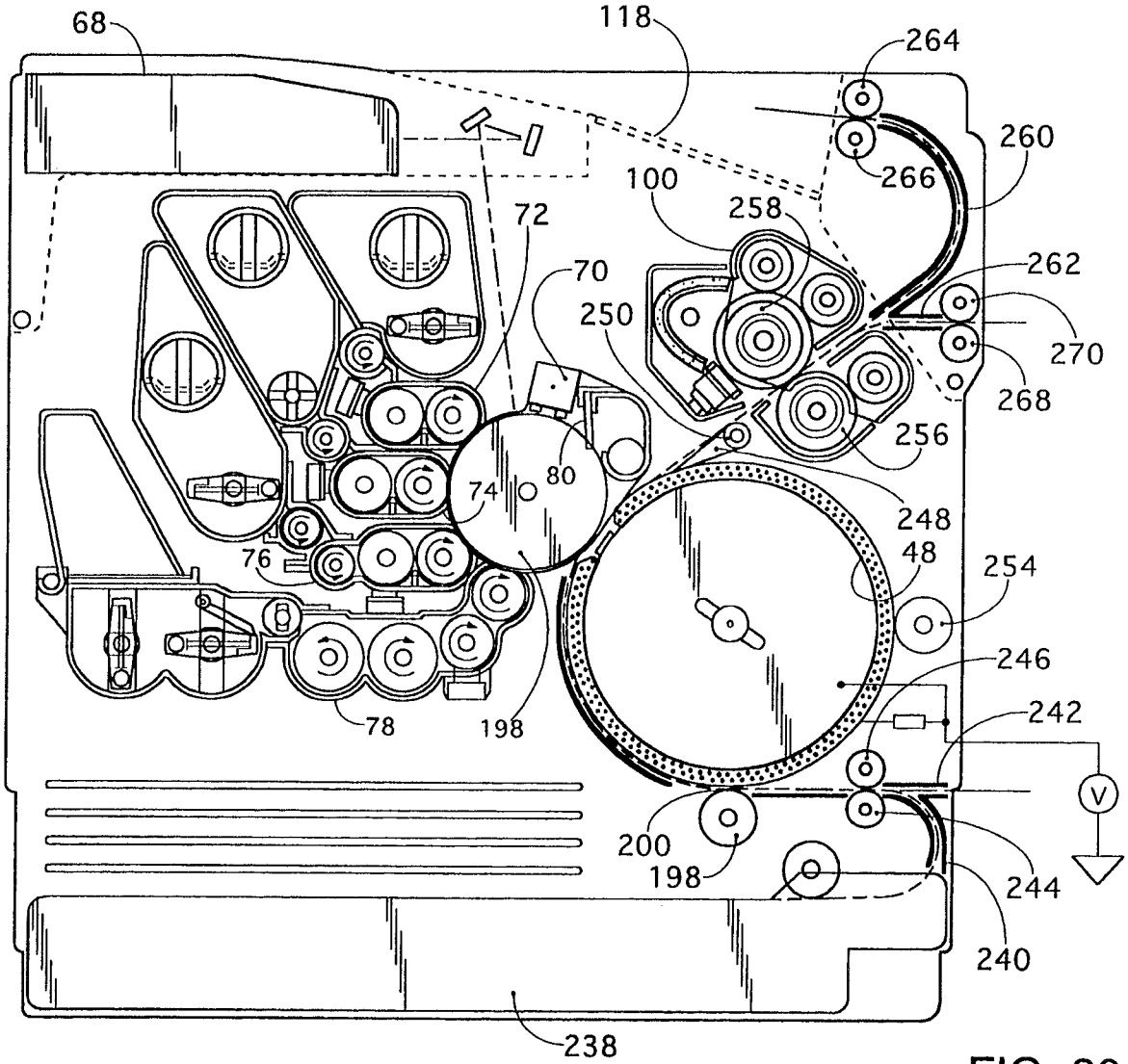
FIG. 30 illustrates a side-view of the overall electrophotographic printer mechanism.

Referring now to FIG. 30, there is illustrated a side-view of the overall electrophotographic printer mechanism depicting an embodiment of the present invention utilizing a buried electrode drum 48 which utilizes a single electrode or multiple electrodes and the gripping layer described hereinabove with respect to FIGS. 10, et seq. The paper is fed from a paper tray 238 into an inlet paper path 240. Further, it can be routed from a manual exterior paper path 242. The paper is then routed between two rollers, a lower roller 244 and an upper roller 246, which provide a "pre-curl" operation, which will be described in more detail hereinbelow. The paper is then fed into the nip 200 between the attach electrode roller 198 and the drum 48, as described above.

After the multiple images have been disposed on the paper for a color print, or a single image has been disposed on the paper for a black and white print, a stripper arm 248 is provided that is operable to rotate down about a pivot point 250 onto the surface of the drum 48 to extract or "strip" the paper from the surface of the drum 48, since the paper is electrostatically held to the drum 48. For multiple prints, the stripper arm 248 is rotated up away from the drum and the attach electrode roller 198 is also pulled away from the drum during the multiple passes.

A cleaning roller 254 is provided which can be lowered onto the surface of the drum 48 for a cleaning operation after the paper has been stripped therefrom and prior to a new sheet being disposed thereon. Although not illustrated, a brush or roller similar to the roller 40 of FIG. 6A is utilized to supply voltage to the electrode layer.

The rollers 244 and 246, as will be described in more detail hereinbelow, are utilized to place a "pre-curl" on the paper such that it curves upwards about the drum 48. This significantly lowers the voltage required in order to attach the paper with the attach electrode roller 198. If this is not utilized, a significantly higher voltage is required to properly grip paper or the paper will slip. It is necessary for the paper to go around at least one revolution before the paper relaxes onto the drum in the appropriate shape, after which the voltage could be lowered. However, by pre-curling the paper with the rollers 244 and 246, this is alleviated. This pre-curl operation is achieved by using slightly different durometers for the rollers 244 and 246.

The fuser 100 incorporates two rollers 256 and 258, the roller 258 being the heated roller and the roller 256 being the mating roller to form a nip therebetween. When the stripper arm 248 strips the paper off of the surface of the drum 248, this paper is routed into the nip between the rollers 258 and 256. The durometers of the rollers 258 and 256 are selected such that the roller 256 is softer than the roller 258 and such that the paper will tend to curl around the roller 258, thus providing a "de-curl" to the paper to allow the paper to again flatten out. The durometer of the roller 256 is approximately 30 mms and the durometer of the roller 258 is approximately 40 mms. The paper is then forwarded to either a transfer path 260 or a transfer path 262. The transfer path 260 feeds to the nip between two rollers 264 and 266 for output onto the platform 118. The paper path 262 is routed to the nip between two rollers 268 and 270 for output to an external tray. In addition, as is well known in the art, the paper will tend to curl toward the surface of the fused toner, which is opposite the precurl direction. Therefore, fuser roller durometer need not fully compensate for the precurl operation.

As shown in FIG. 30, toner module 72 is the three color module containing all the required components for development of the color electrostatic latent image on the photoconductor. It is shown as a single inseparable unit to facilitate user handling and is separate from the black module 78, so that the black materials can be handled identically to a black and white only print engine. Furthermore, the color module uses a mechanism to withdraw the developer brush such that the entire unit does not need to be moved, thereby reducing the space and power required to operate the unit.

Figure 31:
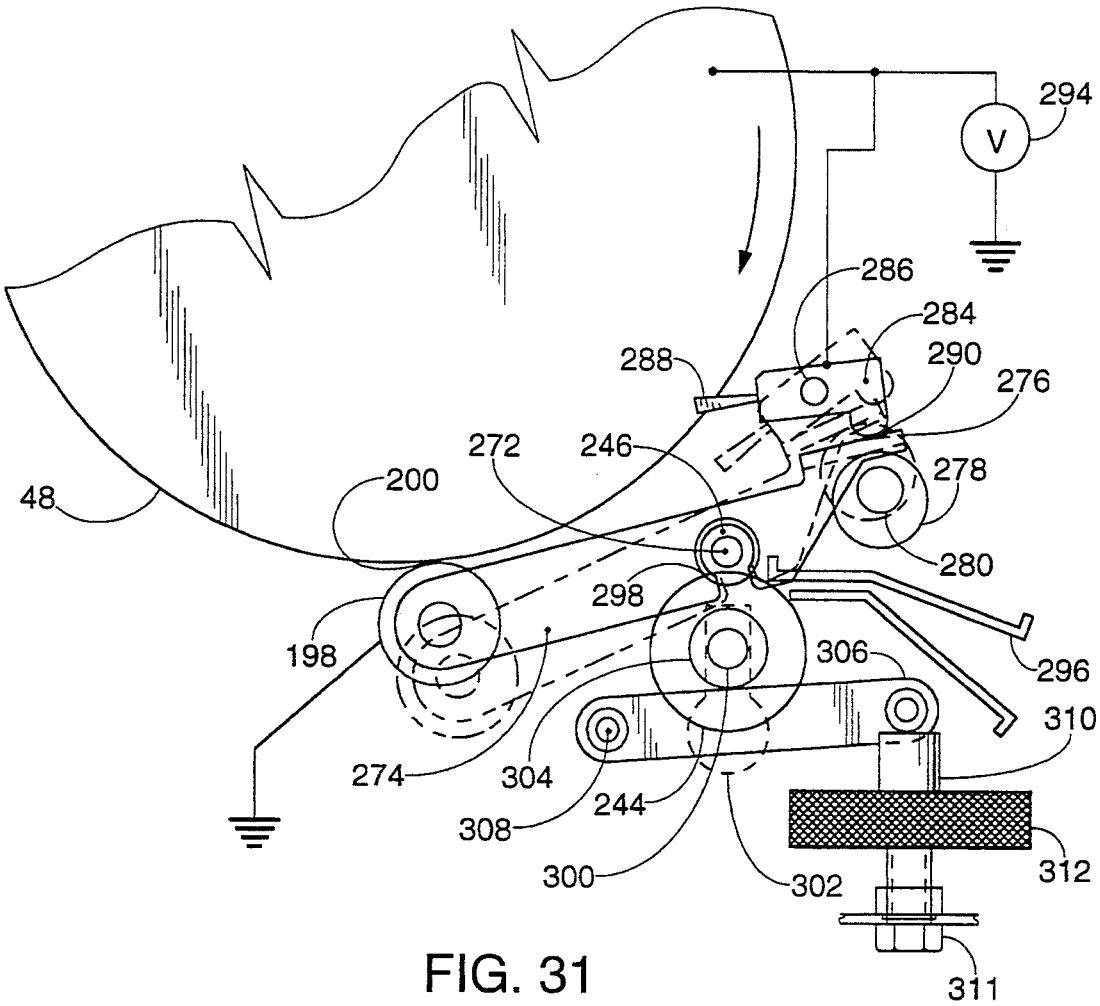
FIG. 31 illustrates a detail of the pre-curl device.

Referring now to FIG. 31, there is illustrated a detail of the pre-curl system. A bracket (not shown) is operable to hold a pivot pin 272 about which a pivoting arm 274 pivots. The arm 274 has attached to a distal end thereof the attach electrode roller 198, with a protruding portion 276 on the diametrically opposite side of the pin 272 from the attach electrode roller 198 operable to interface with a cam 278. The cam 278 is operable to pivot about a fixed pivot point 280 on the bracket (not shown) to pivot the arm 274.

The arm 274 is operable to be pivoted into two positions, a first position wherein the attach electrode roller 198 contacts the drum 48, and the second position (shown in phantom line) which pulls the attach electrode roller 198 away from the drum. A discharge electrode 284 is pivoted about a pivot pin 286 and has an electrode brush 288 disposed on one end thereof. The discharge electrode 284 is operable to pivot in one position such that the electrode brush 288 contacts the surface of the drum 248 to provide a discharge operation prior to the surface of the drum rotating into contact with the nip 200 and, in the second position, to be pivoted away from the surface of the drum 48. The protrusion 290 on the rear portion of the electrode 284 is operable to interface with the protrusion 276 on the pivoting arm 274. The discharge electrode 284 is spring-loaded (not shown) such that it is biased toward the surface of the drum 48 to contact the drum 48, such that when the pivoting arm 274 pivots to move the protrusion 276 away from the protrusion 290, the electrode brush 288 will pivot into contact with the drum 48. When the pivoting arm 274 pivots counterclockwise to move the attach electrode 198 away from the surface of the drum 48, the protrusion 276 urges the protrusion 290 up and pivots the electrode 284 and the electrode brush 288 away from the surface of the drum 48. The discharge electrode 288 is connected to the same attach/-transfer voltage supply, a supply 294, that the buried electrode layer of drum 48 is connected to.

The paper is fed into a paper path 296, which paper path is comprised of two narrowing flat surfaces that direct the paper. The paper is directed to a nip 298 between the rollers 244 and 246. The roller 246 pivots about the pivot pin 272 and the roller 244 pivots about a slidable pin 300. The pin 300 slides in a slot 302 which is disposed in the bracket (not shown). The roller 244 has a durometer that is softer than the durometer of the soft roller 246 such that the paper will tend to roll around the roller 246. The size of the rollers 244 and 246 can be selected to determine the amount of pre-curl required. Further, the durometers of the two rollers 244 and 246 can also be selected in order to accommodate various thicknesses and weights of paper. In one embodiment, the durometer of roller 244 is 20 mms, and the roller 246 is a rigid material such as steel. As such, a given size relationship between the rollers 244 and 246 and a given durometer relationship therebetween for a set force therebetween will not necessarily insure the appropriate pre-curl. If the attachment voltage on the drum 48 is reduced to as low a level as possible, this pre-curl adjustment may be critical to insure that the paper adequately adheres to the surface of the drum 48 for all weights of paper. To facilitate an adjustment to this, the roller 244 has a collar 304 disposed on one end thereof that is rotatable with the roller 244 about pivot pin 300 and the collar 304 interacts with a lever 306. Lever 306 is pivoted at one end to a fixed pivot pin 308 and, at the other end, rests on the end of a piston 310. The piston 310 has a threaded end on the opposite end from the lever 306 which is threadedly engaged with a nut 310 that is secured in the frame. An adjustment wheel 312 is disposed about the piston 310 to allow hand adjustment thereof. In this manner, the pin 300 can be reciprocated within the slot 302. It should be noted that the pin 300 is biased downward against the lever by a spring attachment (not shown).

Figure 31A:
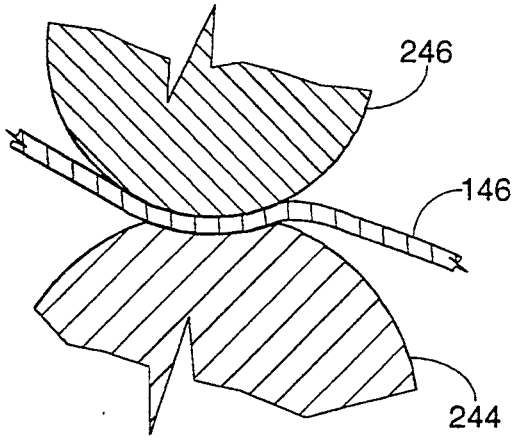
FIG. 31*a* illustrates a detail of the pre-curl operation for the pre-curl rollers.

Referring now to FIG. 31A, there is illustrated a detail of the pre-curl operation for the rollers 244 and 246. It can be seen that the paper is pre-curled by the deformation of the roller 244 such that the paper retains a memory of the curling operation. Thus, when the paper is fed to the attach nip 200, the paper will exhibit less of a normal force directed away from the surface of the drum 48.

As shown in FIGS. 30 and 31, a mechanism comprised of a conductive roll is employed to urge the paper against the BED surface. Although this is the preferred embodiment, it is envisioned that a lower cost alternative would be to use the photoconductor itself as the initial member to urge the paper against the BED surface. This would eliminate the need for the moving member 274 as shown in FIG. 31.

It has been noted that in order to grip paper to a drum or curved surface electrostatically, that the electrostatic gripping forces must be sufficient to overcome the inherent stiffness of the paper. Specifically, the greater the stiffness of the paper, the higher is the electrostatic gripping force and associated voltage to achieve that force. In order to use a single voltage to transfer and grip, the gripping voltage must be reduced for stiffer papers so that the transfer voltage exceeds the minimum voltage threshold for gripping.

Numerous papers have been tested to determine their inherent stiffness and ability to be permanently curled in a hard/soft roller combination. As a result of this testing, it has been determined that there is a minimum threshold of paper deflection that must occur in a precurl system to ensure all materials will be adequately gripped onto the drum. Furthermore, in order to minimize unnecessary curl in paper, this threshold can be adjusted by a predetermined amount and still achieve satisfactory gripping.

Figure 32A:
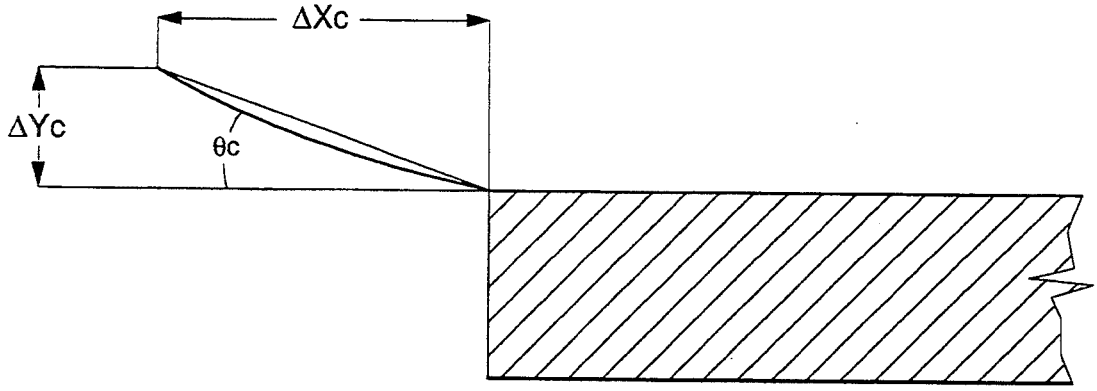
FIGS. 32*a* and 32*b* illustrate devices to measure paper droop and curl.
Figure 32B:
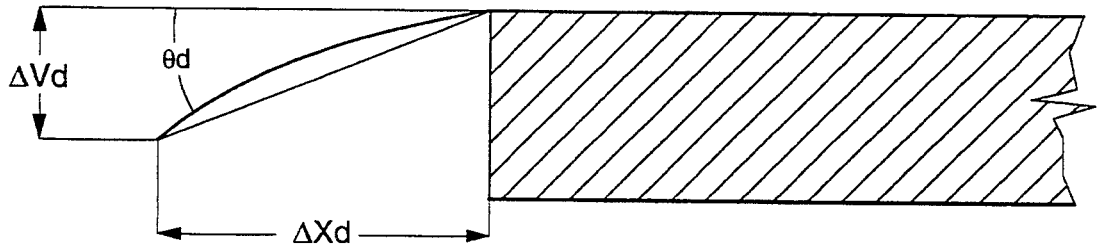
Figure 33:
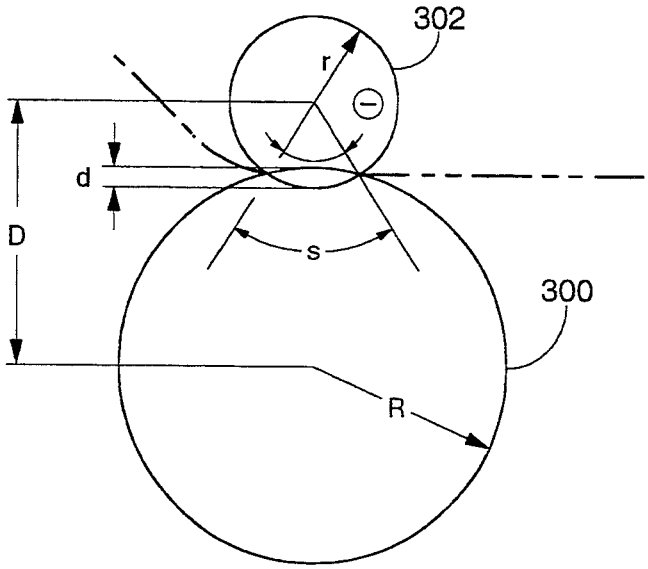
FIG. 33 illustrates a view of the pre-curl rollers.

FIG. 32*a* shows a method to measure the permanent curl or set that occurs in paper after it has been run through the precurling apparatus as shown in FIG. 33. The angle of curl ($\theta_c$) is used to determine the paper's curl characteristic. It was determined by measuring the height off a flat surface that the precurled paper rises. Conversely, some papers are inherently very flexible and do not require precurling to reduce the electrostatic gripping force. FIG. 32*b* shows a method to measure the stiffness (or flexibility) of the paper. In this method, the paper is allowed to droop unsupported over a fixed length and the angle of repose (droop angle) is measured ($\theta_d$).

If these angles are summed, then a figure of merit, M, is provided for paper where the value of M increases for papers that are easier to grip and require less precurl. The figure of merit, "M", is the sum of the paper's stiffness ("Droop Angle", $\theta_d$) and its ability to be curled ("Curl Angle", $\theta_c$):

$$M = k[\mathrm{Tan}\theta_c) + (\mathrm{Tan}\theta_d)] = k\left[\left(\frac{\Delta Y_c}{\Delta X_c}\right) + \frac{\Delta Y_d}{\Delta X_d}\right)\right] \quad (13)$$

Where k is a constant value determined to "normalize" a standard paper. The values $Y_c$, $X_c$, $Y_d$, and $X_d$ are determined from measurements taken from the curl and droop experiments.

Table 3 shows a chart of popular paper types in order of figure of merit. The figure of merit has been normalized to a value of 10 for a widely used paper type in laser printers. Tables 4 and 5 illustrate results of curl and droop experiments for the assortment of papers.

TABLE 3

| Paper Type | Weight (lb.) | Curl $Y_c$ (mm) | Curl $X_c$ (mm) | Droop $Y_d$ (mm) | Droop $X_d$ (mm) | M |
|---|---|---|---|---|---|---|
| Paper Type 1 | 28 | 10.0 | 48.4 | 7.5 | 79.0 | 8.0 |
| Paper Type 2 | 20 | 9.3 | 46.8 | 9.5 | 78.0 | 8.5 |
| Paper Type 3 | 24 | 12.3 | 47.8 | 9.5 | 78.0 | 10.0 |
| Paper Type 4 | 21 | 12.7 | 49.6 | 9.5 | 78.0 | 10.0 |
| Paper Type 5 | 20 | 3.9 | 24.6 | 18.5 | 76.5 | 10.6 |
| Paper Type 6 | 18 | 12.6 | 53.8 | 15.0 | 77.0 | 11.3 |
| Paper Type 7 | 20 | 17.0 | 51.4 | 10.0 | 78.0 | 12.1 |
| Paper Type 8 | 18 | 1.7 | 12.4 | 27.5 | 74.0 | 13.4 |
| Paper Type 9 | 13 | 1.6 | 16.2 | 31.0 | 73.0 | 13.8 |

TABLE 4

| | | | | | |
|---|---|---|---|---|---|
| Large Roller Radius, R (mm): | 12.5 | 12.5 | 12.5 | 12.5 | 12.5 |
| Small Roller Radius, r (mm): | 5.0 | 5.0 | 5.0 | 5.0 | 5.0 |
| Roller Interference, d (mm): | 0.5 | 1.0 | 1.5 | 2.0 | 2.5 |
| Center-to-Center Dist, D (mm): | 17.0 | 16.5 | 16.0 | 15.5 | 15.0 |
| Nip Angle, theta (deg): | 8.6 | 12.0 | 14.5 | 16.5 | 18.2 |
| Nip Width, S (mm): | 1.9 | 2.7 | 3.4 | 4.0 | 4.5 |

TABLE 5

| | Curl Angle + Droop Angle (deg) | | | | |
|---|---|---|---|---|---|
| theta/r (deg/mm): | 1.7 | 2.4 | 2.9 | 3.3 | 3.6 |
| Paper Type | | | | | |
| Paper Type 1 | 5.4 | 12.0 | 17.1 | 20.3 | 23.3 |
| Paper Type 2 | 11.4 | 18.1 | 18.2 | 21.0 | 22.3 |
| Paper Type 3 | 10.2 | 14.8 | 21.4 | 24.1 | 24.1 |
| Paper Type 4 | 11.5 | 13.8 | 21.3 | 23.4 | 24.1 |
| Paper Type 5 | 23.6 | 21.3 | 22.6 | 22.8 | 22.6 |
| Paper Type 6 | 18.5 | 20.3 | 24.2 | 25.1 | 25.3 |
| Paper Type 7 | 10.9 | 19.0 | 25.6 | 27.1 | 26.7 |
| Paper Type 8 | 26.0 | 27.1 | 28.2 | 28.1 | 27.5 |
| Paper Type 9 | 29.4 | 29.3 | 28.6 | 29.6 | 30.6 |

FIG. 33 illustrates the precurl configuration of a soft roller 300 and hard roller 302 that deflects paper through a subtended angle $\theta$ (nip angle). The radius of curvature, r, of the hard roller along with the nip angle, $\theta$, as caused by the interference with the soft roller radius, R, determines the amount of curl. Tables 4 and 5 illustrate the result of the precurl function combined with the stiffness of the paper versus the nip angle by radius of curvature quotient for various paper types. It is interesting to note that the some materials show little change as a function of $\theta/r$. This is due to the fact that these materials are observed to be very flexible and require no precurl to grip, (i.e., they are always above the threshold). Of particular interest is the fact that for good performance for all paper types tested a minimum threshold of 2.9 degrees per millimeter or 15 degrees curl plus droop angle is required. If it is desired to reduce or increase the amount of curl for different media then the appropriate $\theta/r$ can be determined by selecting the curl droop angle sum to be above 15 degrees.

It should be noted that the threshold of cud plus droop may increase to the fourth power of the proportionately to the decrease of the radius of curvature. For example, the gripping threshold for a drum radius of 65 millimeters (the above threshold is for 70 millimeters) would increase by 34% (or $(70/65)^4$) to 20 degrees (3.3 degrees/mm for the stiffest material tested).

Although the preferred embodiment has been described in detail, it should be understood that various changes, substitutions and alterations can be made therein without departing from the spirit and scope of the invention as defined by the appended claims.

What is claimed is:

1. A print engine for creating and transferring an image to a final image carrier, comprising:

a photoconductor member having a latent image carrying surface having at least a portion thereof with an arcuate surface;

an image system for creating a latent image on said photoconductor member and applying toner particles to said latent image to form a developed image;

an arcuate transfer support member;

said photoconductor member and said transfer support member disposed adjacent each other to create a transfer nip between the surface of said transfer support member and the arcuate portion of said photoconductor member surface;

a flexible final image carrier having an initial planar conformation;

a precurl feed device for feeding said final image carrier onto the surface of said transfer image support member at an attachment point prior to said transfer nip and applying a curvature bias thereto such that said final image carrier has an arcuate conformation in the direction of curvature of said transfer support member, that allows said final image carrier to follow an arcuate path in the direction of curvature of the surface of said transfer support member defined as a predetermined number of degrees of path curvature per path millimeter or travel that is greater than a predetermined minimum and a combined curl-droop angle greater than a predetermined minimum, said curl-droop angle defined as the sum of the angle of response of said final image carrier prior to deformation thereof over an unsupported fixed length and the angle of said final image carrier over a fixed length after deformation thereof, wherein said developed image is transferred to said final image carrier as it passes through said transfer nip;

a decurl member for selectively extracting the final image carrier from said transfer support member on the opposite side of said transfer support member from said precurl feed device and applying a curvature bias thereto opposite to the curvature bias provided by said precurl feed device such that said final image carrier is substantially returned to said initial planar conformation; and control system for rotating said transfer support member and said photoconductor member to draw said final image carrier through said transfer nip and transfer said latent image thereto.

2. The print engine of claim 1, wherein said final image carrier comprises paper.

3. The print engine of claim 1, wherein said photoconductor member comprises a photoconductor drum which has a cylindrical shape.

4. The print engine of claim 1, wherein said arcuate transfer support member comprises a transfer support drum having a cylindrical shape.

5. The print engine of claim 1, wherein said precurl feed device comprises a first roller having a first durometer and a second roller having a second durometer that is different from said first durometer, said first and second rollers forming a feed nip therebetween, said first and second rollers applying pressure to said feed nip such that one of said first and second rollers has more deformation associated therewith relative to the other due to the difference in said first and second durometers to apply a curvature bias to the said image carrier when said image carrier is drawn through said feed nip.

6. The print engine of claim 1, wherein said precurl feed device applies said curvature bias to said image carrier prior to said image carrier contacting said transfer support member at said attachment point and said precurl feed device including an attachment device for attaching said image carrier after said curvature bias is applied thereto to the surface of said transfer support member.

7. The print engine of claim 6, wherein said attachment device comprises a device for electrostatically adhering said image carrier to said transfer support member.

8. The print engine of claim 6, wherein said attachment device comprises:

an attachment roller for being disposed adjacent said transfer support member at said attachment point to form an attachment nip between said attachment roller and the surface of said transfer support member, said image carrier urged toward said attachment nip; and means for adhering said image carrier onto the surface of said image support member as said image carrier passes through said attachment nip.

9. The print engine of claim 8, wherein said attachment roller comprises a device for creating an electrostatic adhesion between the surface of said transfer support member and said final image carrier as said final image carrier passes through said attachment nip.

10. The print engine of claim 1, wherein said control system is operable to control said image system to create multiple latent images in successive transfer operations on said photoconductor member and develop the latent images as composite developed images and control said precurl feed device to feed said final image carrier onto said transfer support member during a first transfer operation such that said transfer support member is operable to carry said final image carrier through said transfer nip for each multiple copy of said latent image until all of the composite developed images are disposed on said final image carrier, wherein said decurl member is controlled to selectively extract said final image carrier from the transfer support member after the last of said multiple composite developed images are transferred to said final image carrier.

11. A print engine paper feed device for feeding paper onto a rotating image carrier with an arcuate surface and extracting the paper therefrom, comprising:

a directing device for directing a sheet of paper with a substantially planar conformation along a defined path;

a precurl device for deforming said sheet of paper to have an arcuate deformation in the direction of the rotating image carrier, that allows said sheet of paper to follow an arcuate path in the direction of curvature of the surface of the rotating image carrier defined as a predetermined number of degrees of path curvature per path millimeter of travel that is greater than a predetermined minimum and a combined curl-droop angle than a predetermined minimum, said curl-droop angle defined as the sum of the angle of repose of the said sheet of paper prior to deformation thereof over an unsupported fixed length and the angle of curl of said sheet of paper over a fixed length after deformation thereof;

an attachment device for attaching the paper to the rotating image carrier after arcuate deformation thereof by said precurl device;

an image transfer mechanism for transferring a developed latent image onto the sheet of paper attached to the rotating image carrier;

a paper gripper for extracting the paper from the surface of the rotating image carrier after the developed latent image has been transferred thereto; and a decurl device for deforming the sheet of paper in the opposite direction that said precurl device deforms the sheet of paper such that said sheet of paper after processing by said decurl device has a substantially planar conformation.

12. The print engine paper feed device of claim 11, wherein said attachment device comprises:

an attachment roller for being disposed adjacent the surface of the image carrier to form an attachment nip therebetween; and means for providing electrostatic adhesion between said sheet of paper after passing through said attachment nip and the surface of the image carrier.

13. A method for creating and transferring an image to an image carrier, comprising the steps of:

providing a photoconductor member having a latent image carrying surface having at least a portion thereof with an arcuate surface;

creating a latent image on the photoconductor member;

providing an arcuate transfer support member;

disposing the photoconductor member proximate to the transfer support member to create a transfer nip therebetween such that the transfer nip is formed between the surface of the transfer support member and the arcuate portion of the photoconductor member surface;

providing a flexible image carrier having an initial planar conformation;

feeding the image carrier onto the surface of the image support member at a point prior to the image transfer nip and applying a curvature bias thereto such that the image carrier has an arcuate conformation in the direction of curvature of the transfer support member;

selectively extracting the image carrier from the transfer support member on the opposite side of the transfer support member from the attachment point and applying a curvature bias thereto opposite to the curvature bias provided in the step of feeding such that the image carrier is substantially returned to the initial planar conformation; and rotating the transfer support member and the photoconductor member to draw the image carrier through the transfer nip and transfer the latent image thereto.

14. The method of claim 13, wherein the image carrier comprises paper.

15. The method of claim 13, wherein the step of providing the photoconductor member comprises providing a photoconductor drum which has a cylindrical shape.

16. The method of claim 13, wherein the step of providing the arcuate transfer support member comprises providing a transfer support drum having a cylindrical shape.

17. The method of claim 13, wherein the step of feeding the paper comprises disposing a first roller having a first durometer adjacent a second roller having a second durometer to form a feed nip therebetween, urging the first and second rollers against each other with a predetermined pressure such that one of the first and second rollers has more deformation associated therewith relative to the other due to the differences between the first and second durometers, such that a curvature bias is applied to the image carrier when the image carrier has gone through the feed nip.

18. The method of claim 13, wherein the step of feeding is operable to apply the curvature bias to the final image carrier prior to the final image carrier contacting the transfer support member at the attachment point and the step of feeding including attaching the final image carrier to the image support member after the curvature bias is applied thereto.

19. The method of claim 18, wherein the step of attaching comprises electrostatically adhering the image carrier to the transfer support member.

20. The method of claim 18, wherein the step of attaching comprises:

providing an attachment roller;

disposing the attachment roller adjacent the transfer support member at the attachment point to form an attachment nip between the attachment roller and the surface of the transfer support member, the image carrier urged toward the attachment nip; and adhering the image carrier onto the surface of the image support member as it passes through the attachment nip.

21. The method of claim 20, wherein the step of attaching comprises creating an electrostatic adhesion between the surface of the transfer support member and the image carrier as the image carrier passes through the attachment nip.

22. The method of claim 13, wherein the step of creating the latent image comprises creating multiple latent images in successive transfer operations on the photoconductor member and the step of feeding the paper comprises feeding the paper during a first one of multiple transfer operations and the step of extracting the paper comprises extracting the paper after the multiple latent images have been transferred to the paper, wherein the step of transferring the latent image comprises transferring one of the latent images during each pass of the image carrier through the transfer nip wherein the image carrier is maintained on the transfer support member for multiple rotations thereof.

* * * * *

UNITED STATES PATENT AND TRADEMARK OFFICE

CERTIFICATE OF CORRECTION

PATENT NO. : 5,398,107
DATED : March 14, 1995
INVENTOR(S) : Jack N. Bartholmae, et al.

It is certified that error appears in the above-indentified patent and that said Letters Patent is hereby corrected as shown below:

Column 1, line 14, replace "particular" with --particularly--.

Column 2, line 46, replace ";" with --.--

Column 3, line 12, replace "12," with --12--.

Column 4, line 4, replace "them" with --there--.

Column 6, line 65, replace "feed" with --fed--.

Column 8, line 1, insert --152-- following "layer".

Column 8, line 25, insert --,-- following "12".

Column 9, line 56, replace "them" with --there--.

Column 10, line 12, replace "A" with --An--.

Column 10, line 19, replace "2 14" with --214--.

Column 10, line 43, replace "axis" with --axes--.

Column 11, line 45, replace "nip attachment" with --attachment nip--.

Column 13, line 46, replace "20" with --198--.

Column 14, line 17, replace "fihn" with --film--.

UNITED STATES PATENT AND TRADEMARK OFFICE

CERTIFICATE OF CORRECTION

PATENT NO. 5,398,107

DATED Mar. 14, 1995

INVENTOR(S) Jack N. Bartholmae and E. Neal Tompkins

It is certified that error appears in the above-indentified patent and that said Letters Patent is hereby corrected as shown below:

Column 8, line 25, insert --,-- following "12".

Column 9, line 56, replace "them" with --there--.

Column 10, line 12, replace "A" with --An--.

Column 10, line 19, replace "2 14" with --214--.

Column 10, line 43, replace "axis" with --axes--.

Column 11, line 45, replace "nip attachment" with --attachment nip--.

Column 13, line 46, replace "20" with --198--.

Column 14, line 17, replace "fihn" with --film--.

Column 14, line 30, replace "dependant" with --dependent--.

Column 14, line 45, equation 10, replace "$V = V_o*\epsilon$ - (t/RC)" with --$V = V_o*e$ - (t/RC)--.

UNITED STATES PATENT AND TRADEMARK OFFICE

CERTIFICATE OF CORRECTION

PATENT NO. :5,398,107

DATED :Mar. 14, 1995

INVENTOR(S) :Jack N. Bartholmae and E. Neal Tompkins

It is certified that error appears in the above-indentified patent and that said Letters Patent is hereby corrected as shown below:

Column 14, line 30, replace "dependant" with --dependent--.

Column 14, line 45, equation 10, replace "$V = V_o*\epsilon - (t/RC)$" with --$V = V_o*e - (t/RC)$--.

Column 15, line 3, equation 12, replace "$V = V_o*\epsilon - (t/f(R,C,V))$ with --$V = V_o*e - (T/F(R,C,V))$.

Column 15, line 13, paragraph before "Tables 1 & 2".

Column 15, lines 26 and 27, replace "manufacture's" with --manufacturer's--.

Column 15, line 56, replace "manufacturers" with --manufacturer's--.

Column 18, line 40, replace "nut" with --piston--.

Column 20, line 35, replace "cud" with --curl--.

Signed and Sealed this

Twenty-third Day of April, 1996

*Attest:*

BRUCE LEHMAN

*Attesting Officer*

*Commissioner of Patents and Trademarks*